US006288693B1

(12) United States Patent
Song et al.

(10) Patent No.: US 6,288,693 B1
(45) **Date of Patent: *Sep. 11, 2001**

(54) PLASMA DISPLAY PANEL DRIVING METHOD

(75) Inventors: Young-Bok Song; Sang Jin Yun; Byeong Cheol Kim; Sung Wook Jung; Bong Koo Kang; Young Hwan Kim, all of Kyungsangbuk-do; Nam Kyu Lee, Daeku-si, all of (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/980,965

(22) Filed: Dec. 1, 1997

(30) Foreign Application Priority Data

Nov. 30, 1996 (KR) ..... 96 60307
Jul. 4, 1997 (KR) ..... 97 31187

(51) Int. Cl.[7] ..... G09G 3/28
(52) U.S. Cl. ..... 345/68; 345/209; 345/60

(58) Field of Search ..... 345/204, 60, 61, 345/62, 63, 147, 103, 89, 68, 69, 209; 315/169.4

(56) References Cited

U.S. PATENT DOCUMENTS 5,029,257 * 7/1991 Kim ..... 315/169.4
5,317,334 * 5/1994 Sano ..... 345/146
5,410,219 * 4/1995 Takei et al. ..... 315/169.4
5,475,448 * 12/1995 Saegusa ..... 348/797
5,835,072 * 11/1998 Kanazawa ..... 345/60
5,854,540 * 12/1998 Matsumoto et al. ..... 315/169.1

* cited by examiner

*Primary Examiner*—Steven Saras
*Assistant Examiner*—Fritz Alphonse
(74) *Attorney, Agent, or Firm*—Fleshner & Kim, LLP

(57) ABSTRACT

Provided is a method of driving a plasma display panel, which is a sub-field driving method for the plasma display panel with scan and addressing drive signals, including the steps of: a) dividing scan lines of a field into at least two areas, and scanning the areas; b) displaying a sub-field by applying different address pulses to the respective areas during the scanning; and c) repeating the preceding steps to drive the sub-field, thereby displaying the field.

7 Claims, 21 Drawing Sheets

PLASMA DISPLAY PANEL DRIVING METHOD

BACKGROUND OF THE INVENTION

1. Field of the Invention

The present invention relates to flat panel display devices and, more particularly, to a method of driving a plasma display panel (PDP) among the flat panel display devices.

2. Discussion of Related Art

Generally, cells forming a pixel of PDP are discharging regions insulated by a spacer between upper layer and lower layer. These cells perform discharging by controlling voltages applied to horizontal and vertical electrodes formed on each of the upper and lower layers. An amount of discharged light is controlled according to the variation of the discharging time in the cell. The cells are arranged horizontally and vertically according to a specific size, forming the total field of PDP. The PDP displays digital video signals to a specific video field with a scanning driver and an addressing driver. That is, the addressing driver is connected to the vertical electrode, and the scanning driver is connected to the horizontal electrode. The former applies a write pulse for inputting the digital video signal and an erase pulse for stopping the cell discharged by the video signal. The latter realizes a matrix type field by applying the scan pulse for causing discharge according to the video signal and the sustain pulse for sustaining the discharge caused the scan pulse for a predetermined time to the cell on the corresponding horizontal line. To make a continuous image, the following operations are repeated: the scan and write pulses are applied to PDP at the same time in order to discharge; the field is sustained at the discharged state for a predetermined time by the sustain pulse; the field is erased by the erase pulse to display the next field. That is, the preceding discharging, sustaining and erasing operations are repeated to display the next field.

As described above, eight sub-fields are overlapped and sequentially displayed as one field by controlling the scanning and addressing drivers. The method is called sub-field driving method.

In this sub-field driving method, eight sub-fields should be sequentially concentrated to make one image. An one-bit digital image signal corresponds to each of the cells and is applied to each of the 960 lines, thereby forming one PDP sub-field having equal brightness. Therefore, when the eight sub-fields each having different brightness are collected by the digital video signals of eight bits, they make one image. Theses images continuously arranged form the moving picture. That is, the eight sub-fields are classified into sub-fields having different brightness. A first sub-field is formed of digital video signal of most significant bit (MSB), which has highest brightness among those digital signals of eight bits. Each of second through seventh sub-fields has the differentially lower brightness than the first sub-field. An eighth sub-field is made of the digital signal of least significant bits (LSB).

A method of operating these sub-fields is to display eight sub-fields having the digital signals of eight bits from first LSB to last LSB. In other words, those eight sub-fields are formed by scanning the first sub-field for the discharging time T, and another second through eight sub-fields for T/2, T/4, T/8, T/16, T/32, T/64 and T/128. In this way, a complete video field is displayed by a persistence of vision with respect to light emitted from each of the sub-field. To form the sub-field, a predetermined period of time is needed to scan all of the horizontal electrodes. Each of the cells can maintain discharging only during the predetermined period of time, that is, the average time exclusive of scanning time, the average time being allocated to each sub-field. The scanning time increases in proportion to the number of the horizontal electrodes. As one cannot maintain the discharging during the scanning time, contrast and brightness of PDP may be decreased, so that the scanning time should be reduced.

In addition, as the difference of discharging time between the upper bits and the lower bits in forming the sub-field and the sub-fields are formed sequentially, a flickering occurs due to the difference of discharging time. To reduce the flickering, it is needed to arrange the sub-field of upper bit requiring the long discharging time and the other sub-field of lower bit requiring the short discharging time in the appropriate order.

In the sub-field operating method, a gradual gray scale required for displaying image realizes the length of time in which each cell is discharged and maintained differently within the predetermined period of time (1/30 sec. in case of NTSC TV) given to display total image. Here, the brightness of the field is determined by the gray scale when each cell is operated maximally. To increase this brightness, the operating circuit should be designed to maximally maintain the cell discharging time with the time given for structuring one field. The contrast, the difference in tone between dark area and bright area, can be controlled by the brightness determined. To increase the contrast, it is needed to darken the background and increase the brightness. Specifically, in case of flat display panel devices for high resolution television, as the gray scale should be 256 units, the resolution should be 1280×1024 and contrast should be more than 100:1 under the light of 200 Lux, 8 bits of R. G. B. data are respectively required for the video digital signals for displaying the gray scale of 256 units, and the discharging time of the cell should be maximally maintained to gain the required brightness and contrast.

An conventional PDP operating method will be described below.

FIG. 1 is a sectional view of an surface discharged cell of AC PDP having the three electrodes typically used.

A spacer 10 maintains first and second insulting layers 1 and 2, and insulates the gap among cells. Row electrodes are made of a scan electrode 11 and a common electrode 12 and arranged on the first insulating layer 1 in parallel.

The column electrode 4 is arranged on the second insulating substrate 2 to oppose to the row electrode, keeping a matrix shape. The first and second insulating layers 5 and 6 respectively covers the row electrode and the column electrode 4, protecting the electrodes. As the electrodes are covered with the insulating layers, if a series voltage is applied between the electrodes to discharge, the discharging is erased instantly. In case of the PDP having the thus-structured electrodes, a parallel voltage whose polarity is continuously inverted should be applied between electrodes to maintain the discharging.

A passivation layer 7 is deposited on the second insulating layer 5. The passivation layer 7 is typically made of thin film of MgO in order to protect the insulating layer 5, enlarge its lifetime, increase the efficiency of emitting second electrons and reduce the variation in the discharging characteristics caused by the contamination of oxide in refractory metals.

A fluorescent layer 9 is deposited on the second insulating layer 2 including the spacer 10, and excited by ultraviolet rays generated due to the discharging, generating visible rays of R. G. B. colors. A discharge space 8 is the cell space in which the discharging is performed. To increase the ultraviolet ray emitting efficiency, a mixture of Ar and Xe is filled in the space.

FIG. 2 shows an arrangement of the conventional AC PDP electrodes.

Each of the cells 13 is formed at the intersecting point where the column electrode intersects with the row electrode. The row electrode has scan electrode group $S_1$ through $S_m$ mainly used for scanning field, and common electrode group $C_1$ through $C_m$ mainly used for maintaining the discharging. The group of the row electrode is made of the address electrodes $D_1$ through $D_n$ used for data input.

A sealing region 14 is used for maintaining vacuum state of the entire PDP, and formed by inserting the spacer 10 between the first and second insulating layers 1 and 2 and sealing the edge of the PDP with adhesives.

An operation waveform with respect to each electrode and its sub-field scanning method are classified into two method. Firstly, their operation waveforms are shown in FIG. 3. A sustain pulse is applied to the common electrodes $C_1$ to $C_m$ to maintain the discharging of the cell 13. The scan electrodes $S_1$ to $S_m$ receive another sustain pulse whose shape is the same as the pulse of the common electrodes $C_1$ to $C_m$ but its position of the time difference is different. If one of the cells $S_1$ and $D_1$ should be discharged, a positive data pulse is input to the address electrode $D_1$ and the scan pulse is synchronized with the data pulse and thus input to the scan electrode $S_1$, the voltage level between the electrodes $S_1$ and $D_1$ is increased higher than the threshold level and discharged.

This state is maintained until the next erase pulse is input thereto by the electronic field generated with the discharged particles in the insulating layer and the electronic field generated by the sustain pulse of the scan and common electrodes $S_1$ and $C_1$. If an erase pulse having lower amplitude than the scan pulse is applied thereto, the sum of the electronic field of discharged particles and another electronic field of the erase pulse is too small to continuously maintain the discharging, so that the discharging is erased when the next sustain pulse is applied thereto.

In brief, the scan electrodes perform the sustain function and scanning function but the common electrodes only perform the sustain function. The address electrodes input data for structuring field.

Each pulse through the scan electrodes $S_1$ to $S_m$ performs the sequential scanning operation to Sn for 2 to 3 $\mu$s. In synchronization with the scanning operation, if data pulses as many as the number of the lines in the scan electrodes are applied through the address electrodes $D_1$ to $D_n$, each cell of the PDP field momentously display the sub-field of the equal brightness to the random digital image data.

A method of displaying eight sub-fields corresponding to each of the 8 bits digital image data is described below.

FIG. 4 shows a scan method in the conventional sub-field operation method for realizing the gray scale of 256 units on basis of the operation waveforms of FIG. 3. Here, a field is made of eight sub-fields, and the time allocated to each of the sub-fields is constant as $T_A$. Accordingly, as a field is made of eight sub-fields, the required time $T_{FIELD}$ is $8T_A$. Here, within $T_A$, times of $T_A/2$, $T_A/4$, $T_A/8$, $T_A/16$, $T_A/32$, $T_A/64$, and $T_A/128$ are only used for discharging sequentially from MSB to LSB. Therefore, within $8T_A$ for structuring a field, the time $T_s$ for discharging is $2T_A$, and the time $T_{NS}$ not allowed to discharge is $6T_A$. Waste and efficiency of the wasted time $T_{NS}$ is as follows.

$$\text{Waste } \frac{T_{ns}}{T_{FIELD}} \times 100 \frac{6}{8} \times 100 \quad 75\% \qquad \text{[Equation 1]}$$

$$\text{EFICIENCY} \frac{T_s}{T_{FIELD}} \times 100 \frac{2}{8} \times 100 \quad 25\%$$

The above equation 1 shows that the time which can be used actually for discharging is below 25% in case of using PDP to which the sub-field operating method is applied, and it means that this plays a main factor of decreasing brightness in the PDP.

Its operational waveform and scan method are respectively shown in FIGS. 5 and 6.

In the waveforms of FIG. 5, the first sub-field is divided into a reset period, an address period, and a sustain period, completely separating addressing from sustaining. First, within the reset period, at point (a), the section of the scan electrode from $S_1$ to $S_m$ has the value of 0(V) and a light pulse is input to the common electrodes $S_1$ to $S_m$, so that an initial discharging starts between all common electrodes and scan electrodes.

Thereafter, at point (b), a sustain pulse is input to each of the scan electrodes and therefore the sustain discharging is generated. At point (c), the total erase pulse is input to the common electrodes, erasing the discharging of all cells. The next address period starts with point (d) and ends right before the point (f). Here, at the point (d), the positive (+) voltage of the same value is applied to each of the scan and common electrodes in order to prepare for the addressing starting from point (e). At the point (e), the data pulse of the address electrode is synchronized with the scan pulse of the scan electrode and input. If the positive data pulses are input to the cells belonging to the row electrodes to which the scan pulse is input, the wall electrons are formed due to discharging, generating the sustain discharging in the following sustain period. If the data pulse of 0(V) is input, the sustain discharging cannot be generated in the sustain period. The scan pulses are sequentially input to all row electrodes in the order of $S_1$, $S_2$, $S_3$ to $S_m$.

At last, the sustain period starts with the point (f). The method of inputting pulses to the scan and common electrodes is the same as the sustain pulse inputting method of FIG. 3.

FIG. 6 shows the conventional sub-field scan method for realizing gray scale of 256 units on basis of the operational waveforms of FIG. 5.

A field of PDP is made of eight sub-fields, SF1 to SF8. Each of sub-fields is made of reset, address and sustain periods as of FIG. 5. The reset period is positioned at the start point of all sub-fields and renders the initial state where the addressing is available by erasing the discharging of all cells. The time allocated to the reset period is constant to all sub-fields.

The sustain period maintains continuously the discharging of the cells where write discharging is generated in the address period. If the sustain period of SF1 is set to T, the sustain periods of SF2, SF3, SF4, SF5, SF6, SF7 through SF8 are made to 2T, 4T, 8T, 16T, 32T, 64T and 128T, thereby realizing them as the gray scale of 256 units.

In the address period, to enable the cells, which should maintain discharging during the sustain period, to write-discharge, the PDP is scanned sequentially from the highest line by one scan electrode of a row, and the time allocated to each address period is constant with respect to all sub-fields.

But, the time allocated to the address period increases in proportion to the increase in the number of the row electrodes to scan and the time allocated to the sustain period decreases. Therefore, its light emitting efficiency is decreased and it is hard to realize the gray scale of 256 units in the high resolution PDP.

Consequently, the conventional art displays eight sub-fields corresponding to the digital image data of eight bits to realize one field. But, its discharging time in the address period is 25% of the time for displaying one field, having low efficiency, the brightness off PDP is drastically decreased. Specifically, the conventional art has the problem in realizing the gray scale of 256 units in the PDP having high resolution above 640×480 which can be made by keeping the scanning time maximally.

SUMMARY OF THE INVENTION

Accordingly, the present invention is directed to a method of driving plasma display panel that substantially obviates one or more of the problems due to limitations and disadvantages of the related art.

An object of the present invention is to provide a method of driving high resolution AC PDP with high efficiency by using the following methods of: gathering sub-fields having lower bits and making them a group; dividing a field in a direction of row electrode; arranging the groups not to intersect on each field divided for the total one frame period; and maximally having the scan time by simultaneously inputting a scan pulse and sustain pulse to the electrodes of the different rows.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a plasma display panel, which is a method of sub-field driving the plasma display panel with scan and addressing drive signals includes the steps of:

dividing a scan line in a field into at least two areas and scanning the areas;

applying different address pulses to each area during the step of scanning, and displaying sub-fields; and repeatedly performing the preceding steps corresponding to the sub-field driving, and displaying the image field.

Another method of driving a plasma display panel of the invention, which is a sub-field driving method for the plasma display panel with scan and addressing drive signals includes the steps of:

(a) dividing a field into two areas, and alternately scanning the areas in order not to have a time overlap;

(b) displaying sub-fields by applying different address pulses to each divided area during the scanning; and (c) sequentially displaying another sub-fields formed with a combination of address pulses different from those of the sub-fields according to driving the sub-fields.

Further another method of driving a plasma display panel of the invention, which is a sub-field driving method for the plasma display panel with scan and addressing drive signals includes the steps of:

(a) dividing the scan lines of a field into a plurality of areas, and applying scan and sustain pulses without a time overlap; and (b) displaying sub-fields by applying address pulses of upper or lower bits and of another bits to the respective areas during the step (a).

Still another method of driving a plasma display panel of the invention, which is a sub-field driving method for the plasma display panel with scan and address drive signals includes the steps of:

(a) dividing a field into two areas;

(b) applying sustain pulses having different time intervals to each of the divided areas;

(c) applying one or more scan pulses between the sustain pulses without a time overlap;

(d) applying different address pulses by the corresponding pulses while the scan pulses are applied; and (e) repeating the preceding steps to display one sub-field by the applied address pulses, thus displaying the sub-field more than once.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 9A shows a general scanning method occurring in the point of time T on the time axis;

FIG. 9B shows a case where only addressing block is in the point or time T on the time axis;

Figure 13:
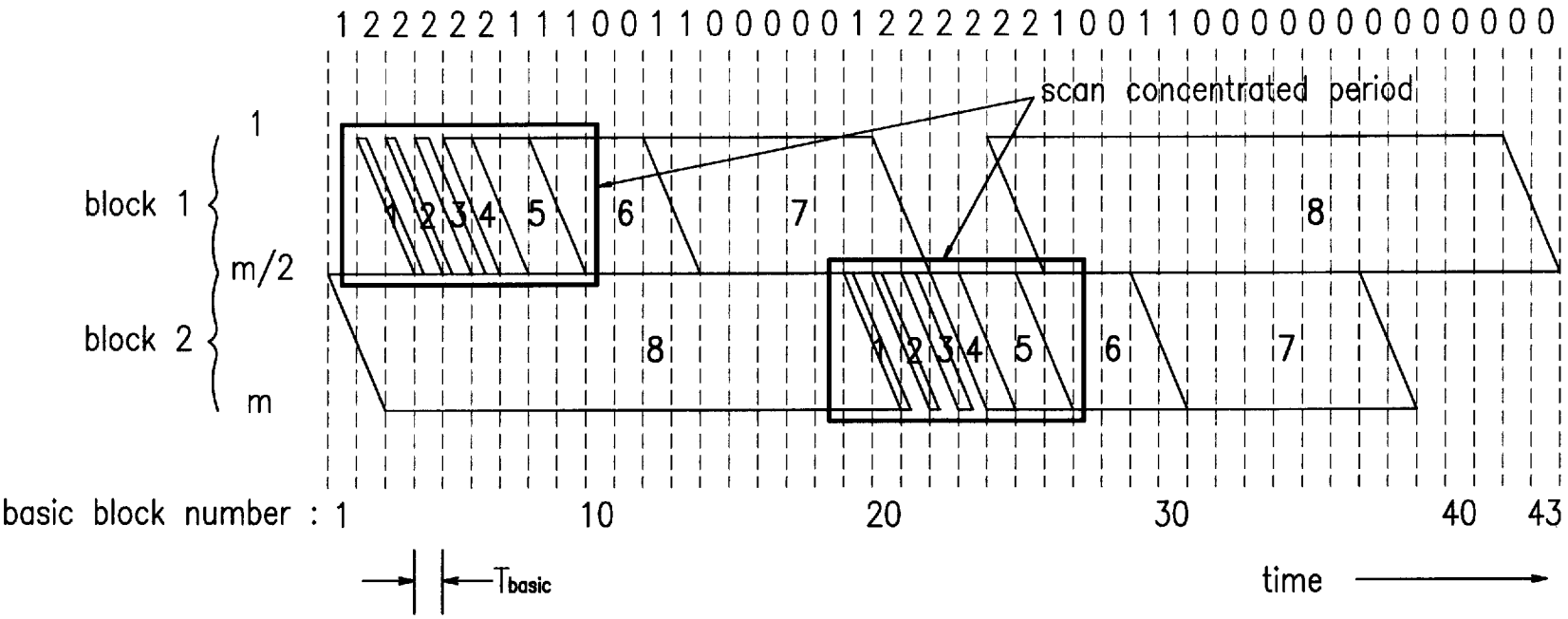
Figure 14:
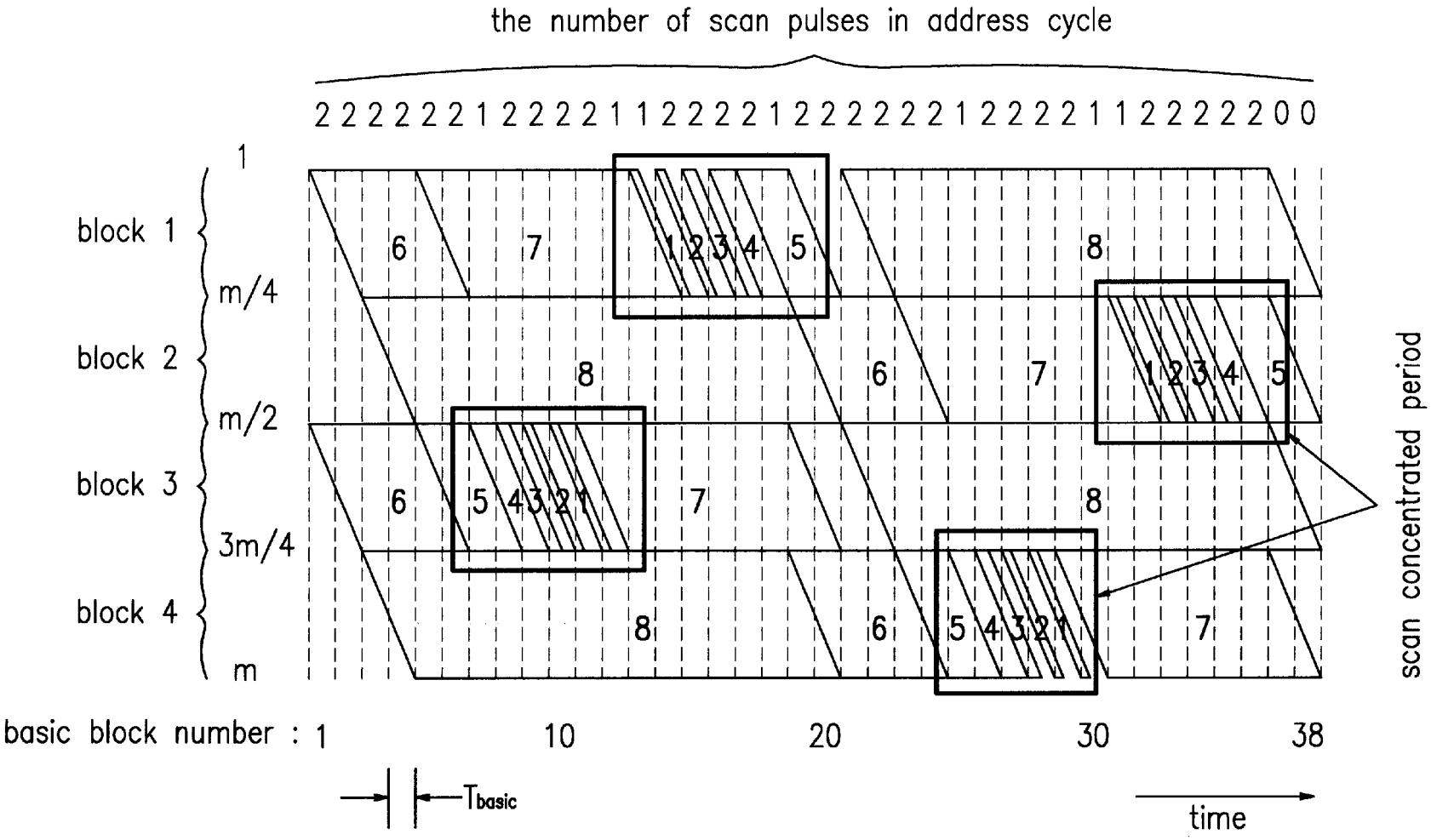
Figure 15:
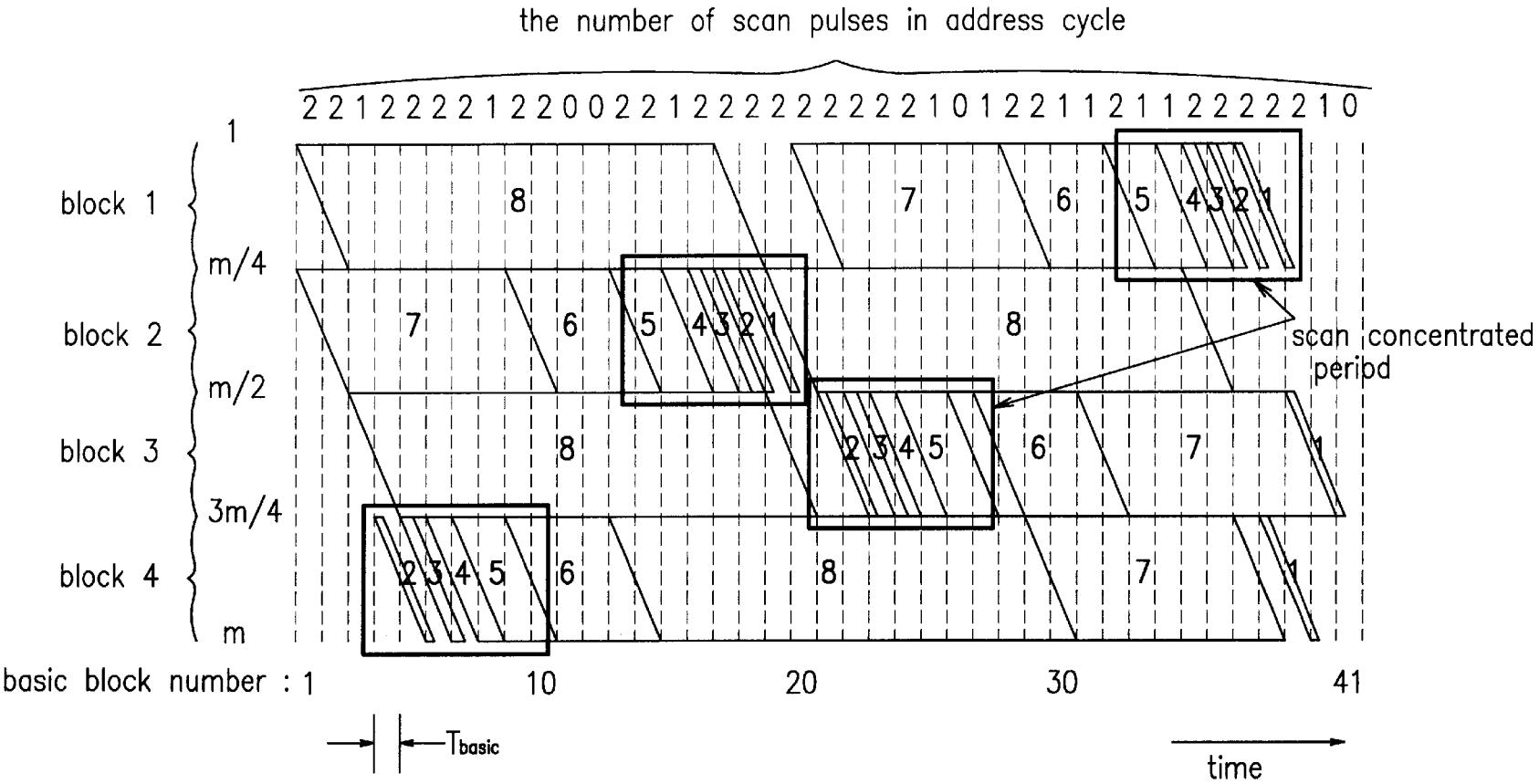
Figure 16:
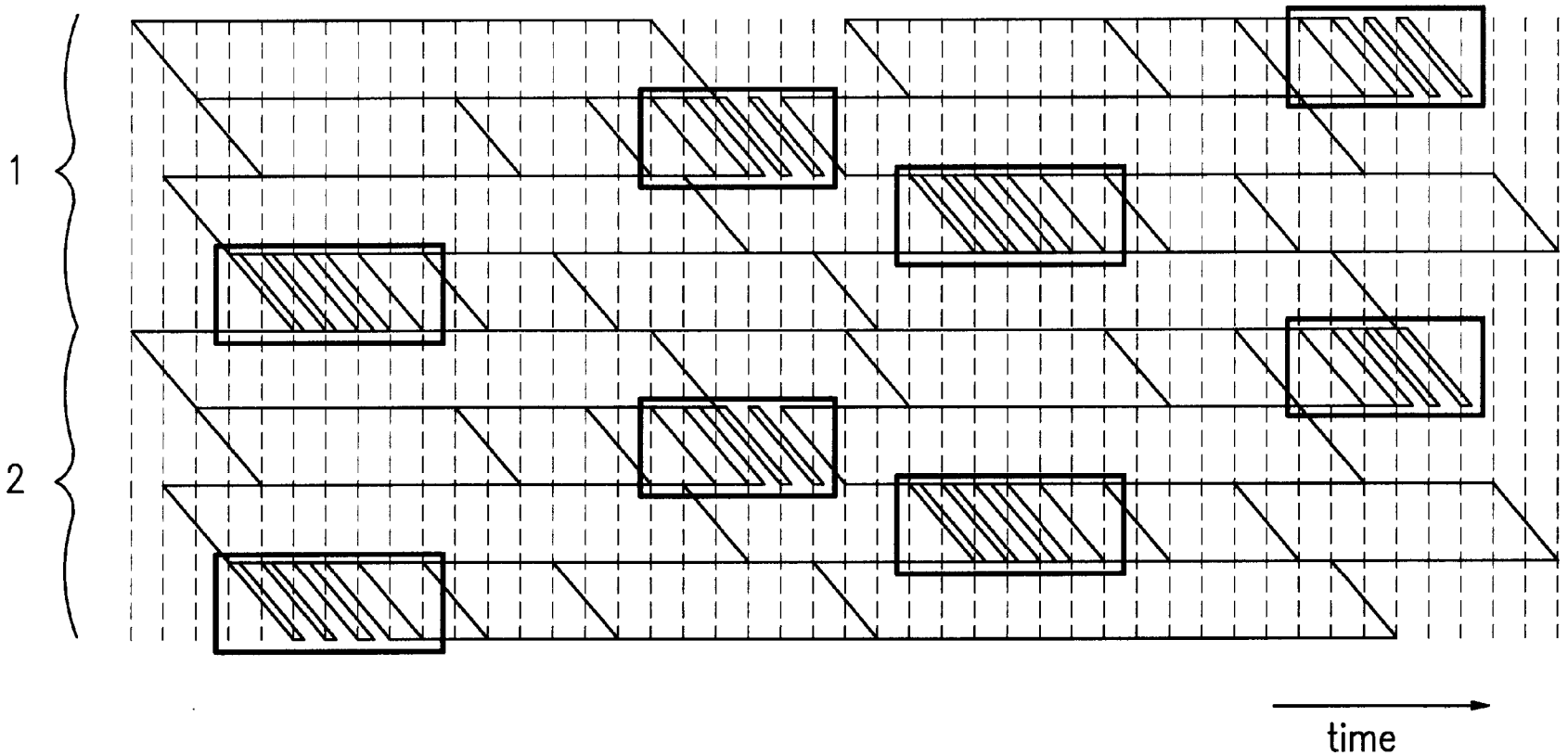
Figure 17:
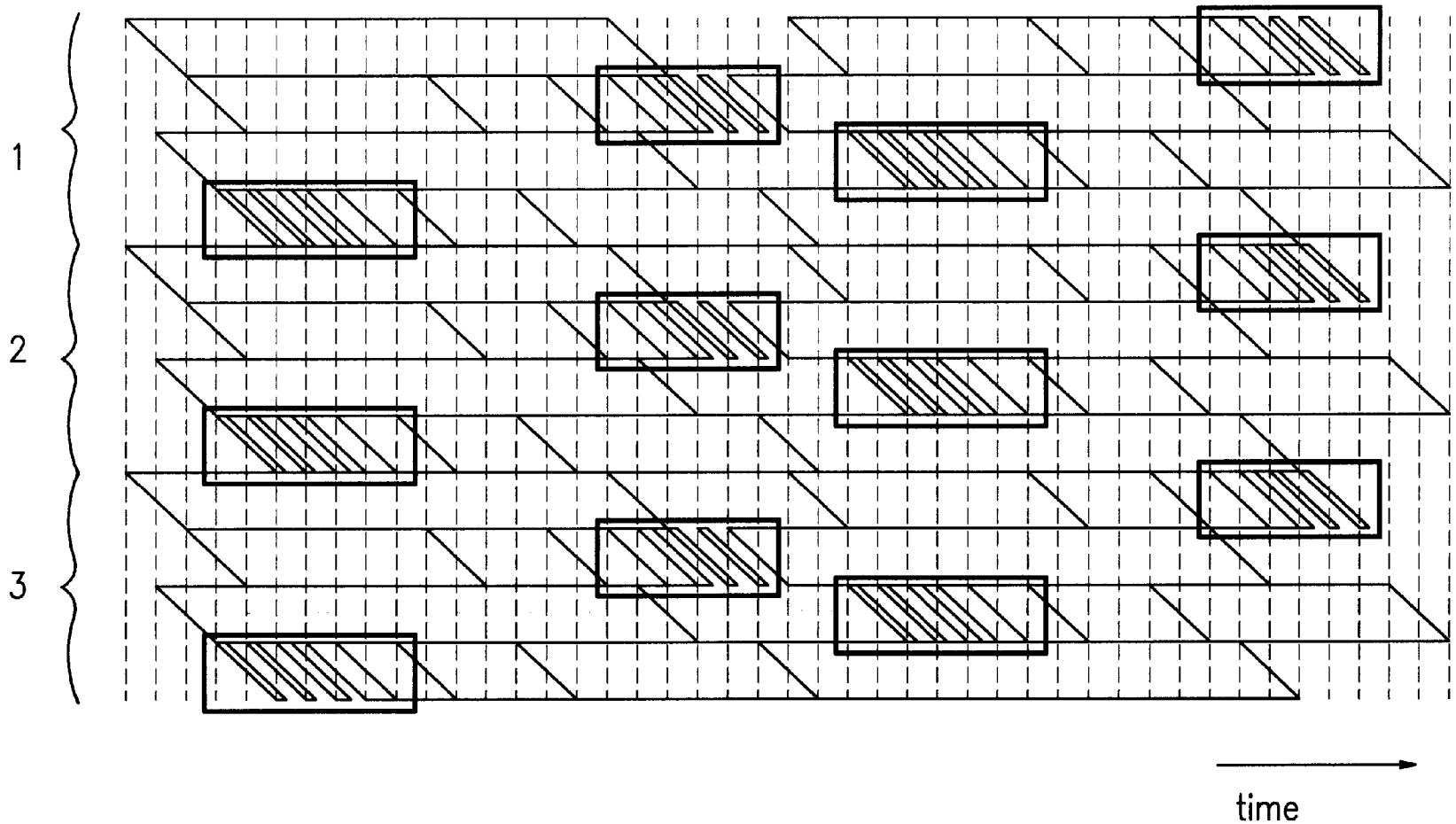
Figure 18:
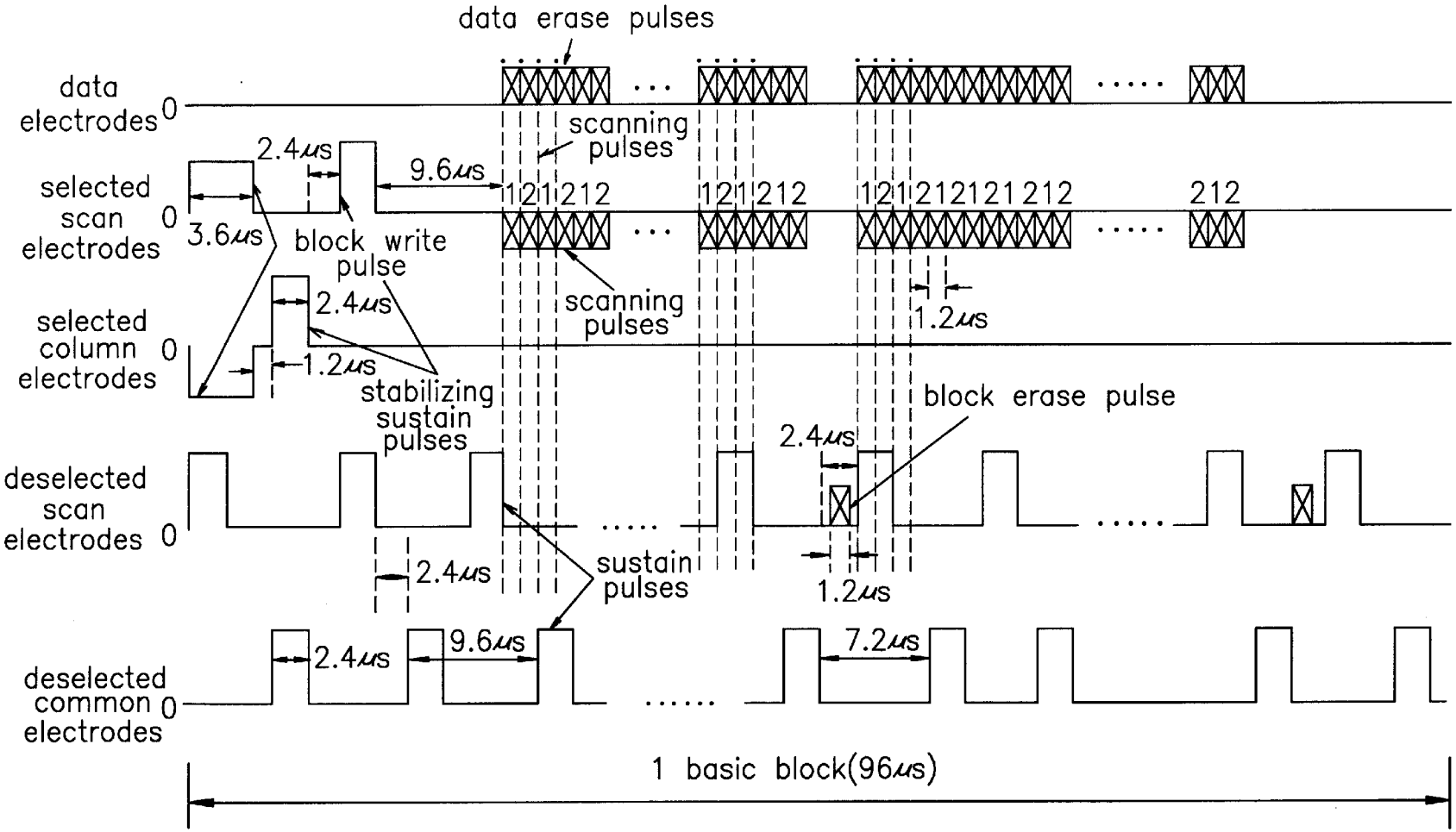
Figure 19:
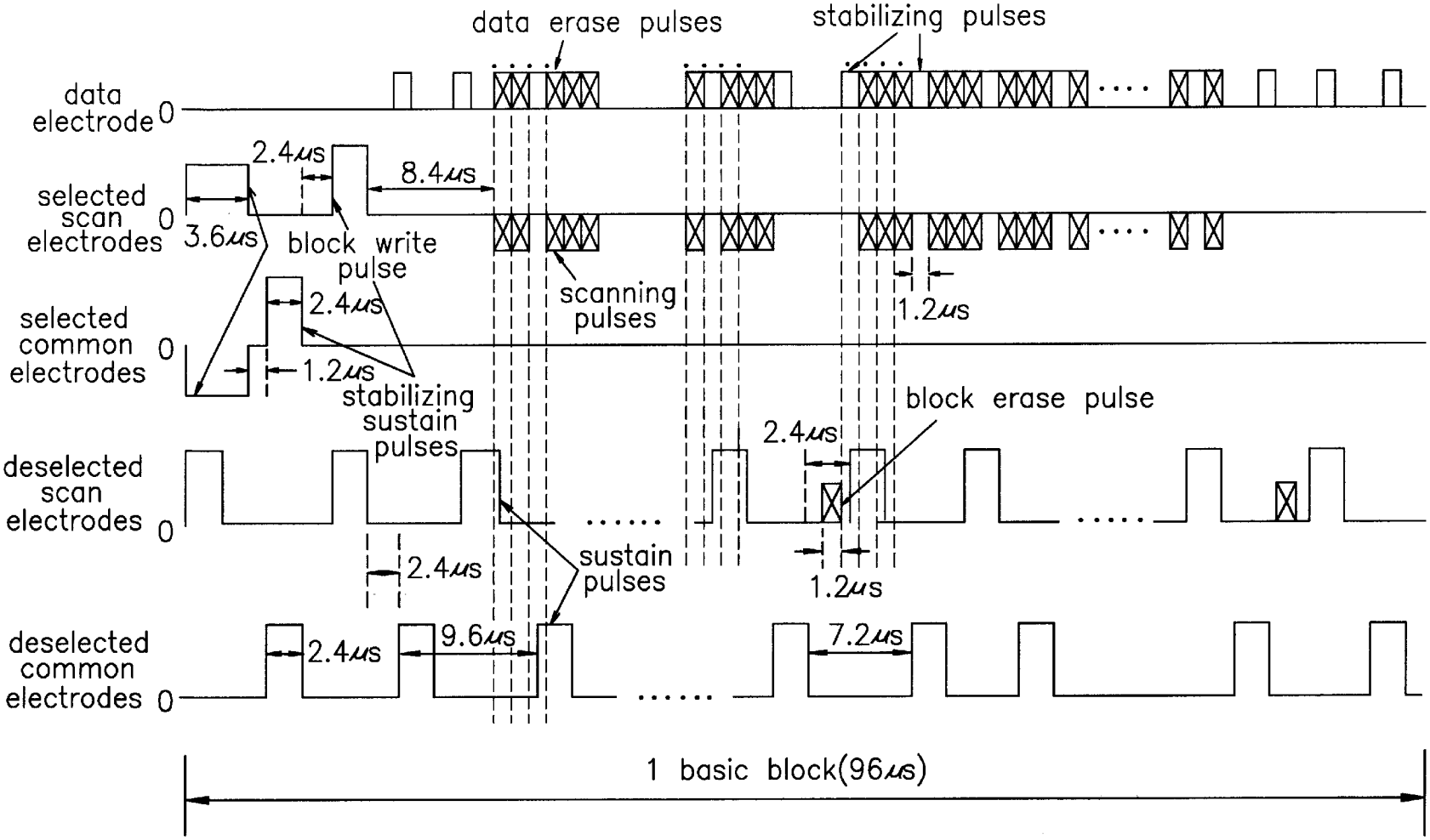
Figure 20:
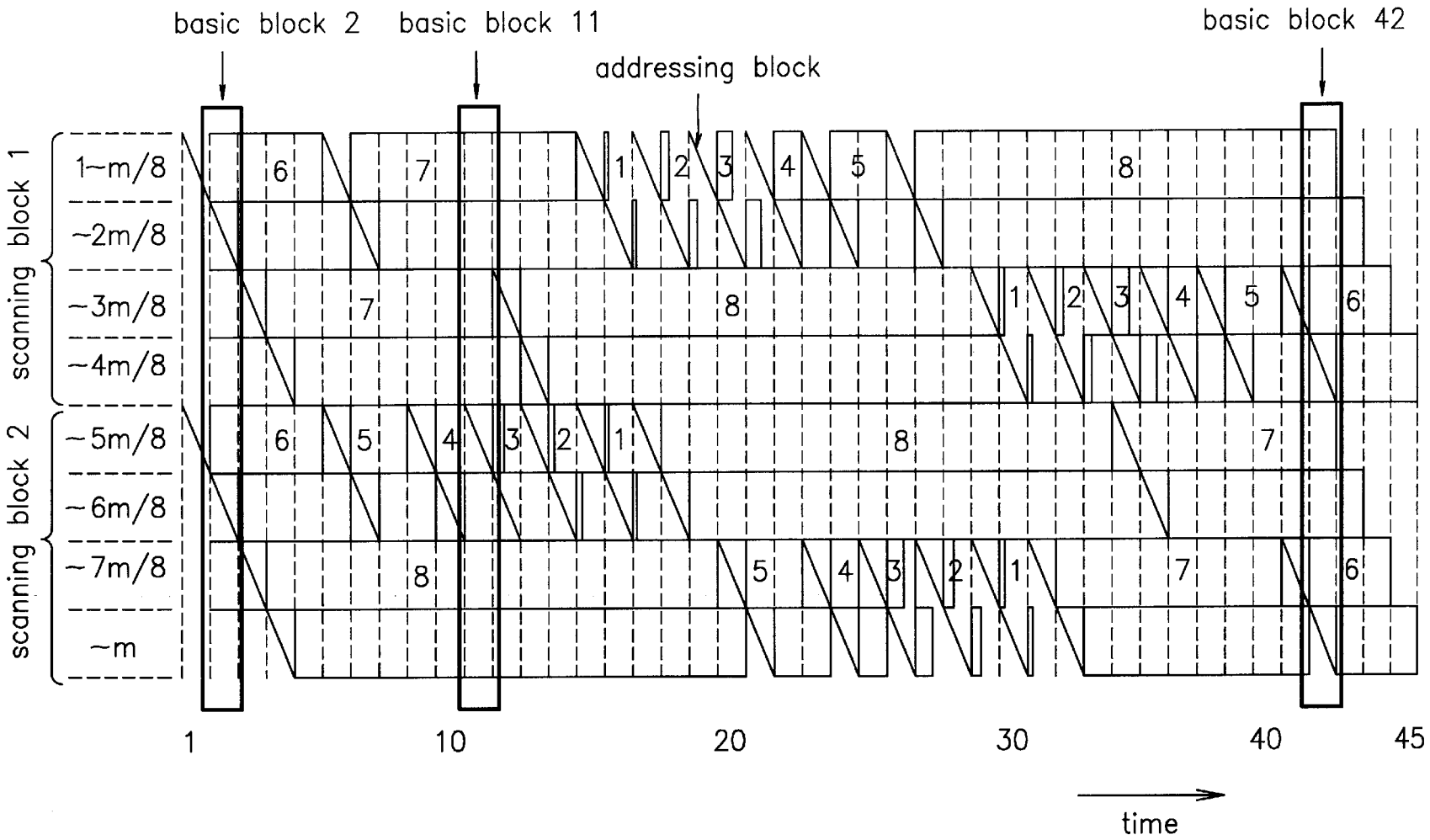
Figure 21:
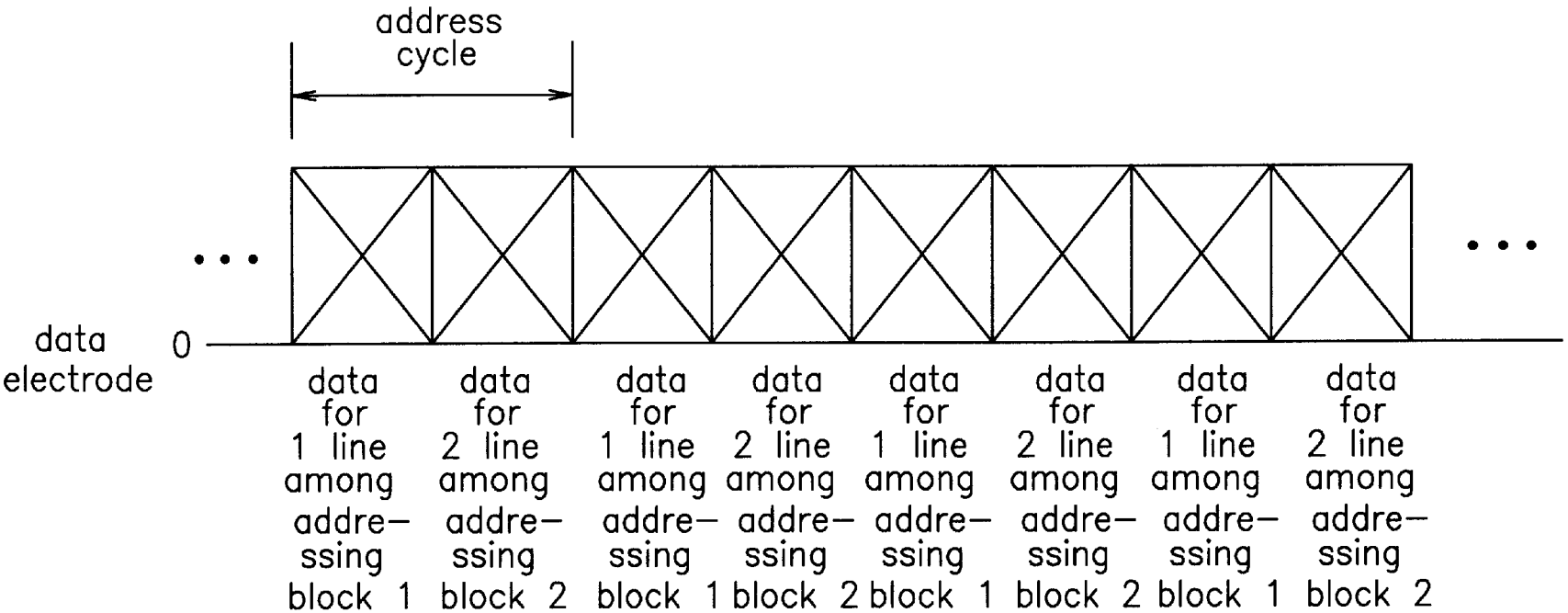
Figure 22:
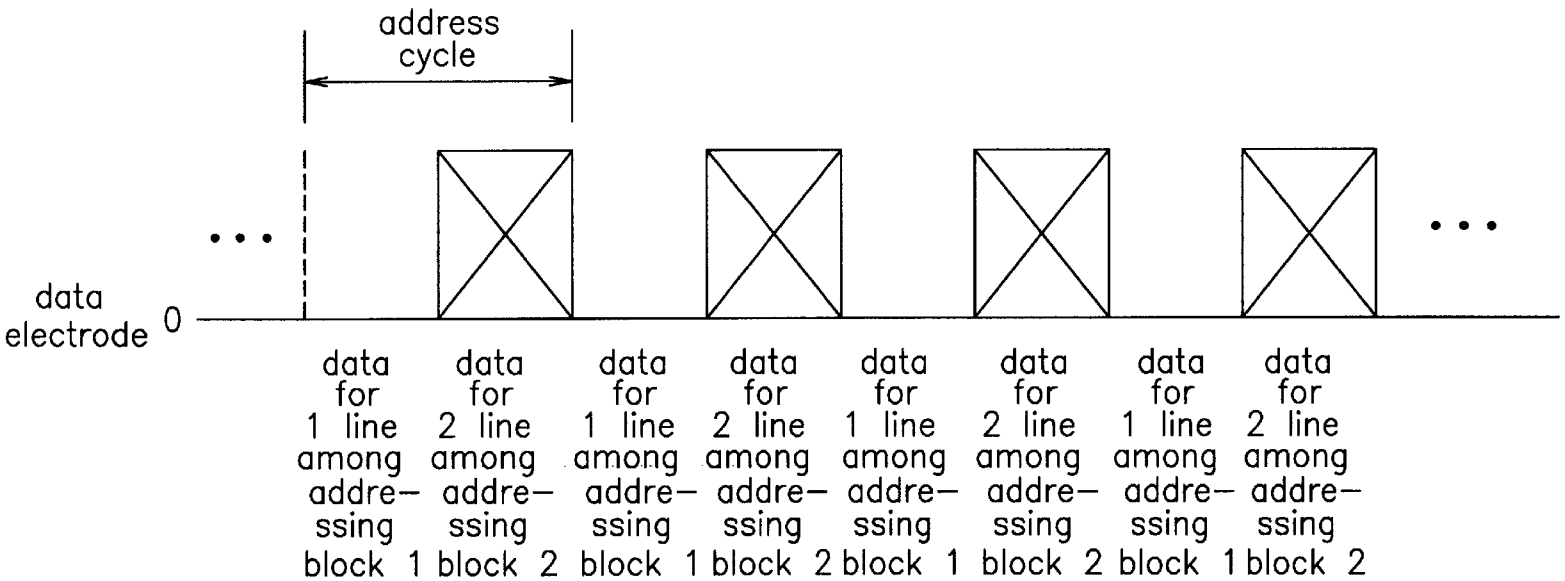
Figure 23:
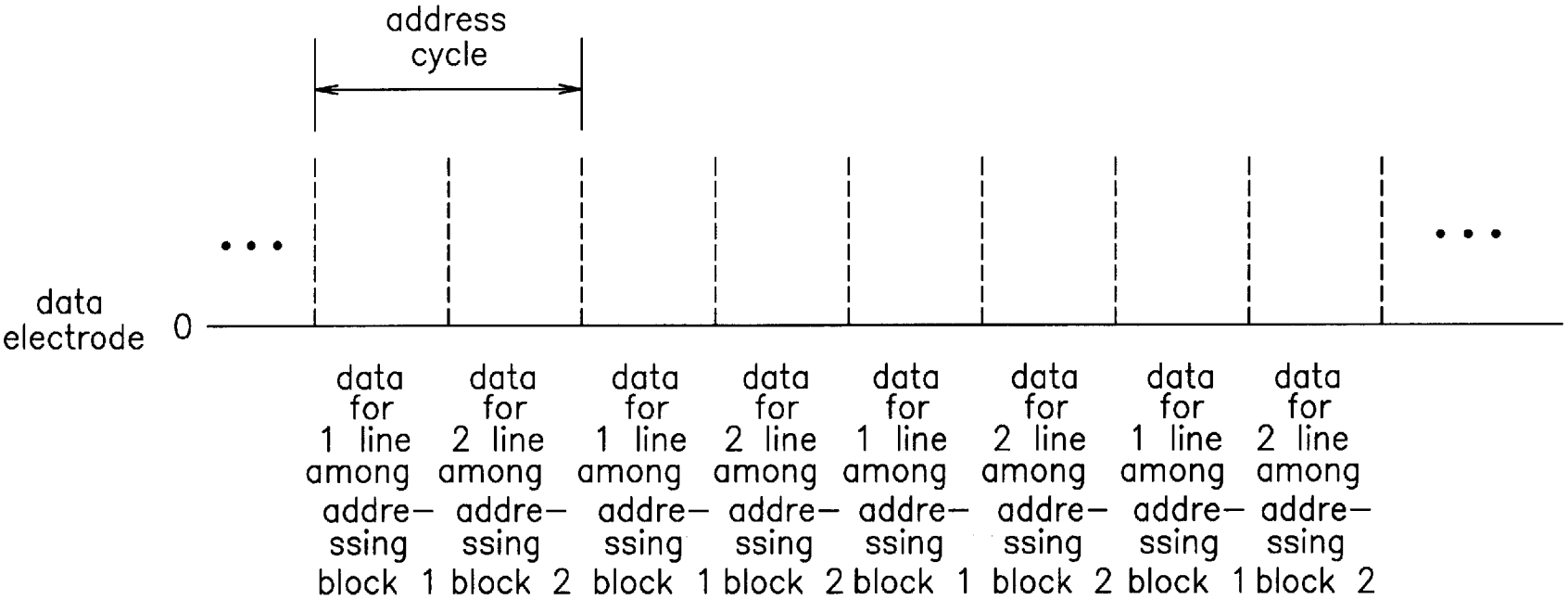

(a) scan concentrated period made of 1(LSB), 2, 3, 4 and 5 sub-fields;

(b) scan concentrated period made of 5, 4, 3, 2 and 1(LSB) sub-fields;

(c) scan concentrated period made of 5, 4, 3 and 2 sub-fields;

(d) scan concentrated period made of 2, 3, 4 and 5 sub-fields;

(e) scan concentrated period made of 1(LSB), 2, 3 and 4 sub-fields; and (f) scan concentrated period made of 4, 3, 2 and 1(LSB) sub-fields;

FIG. 13 shows a sub-field scanning method in which the field is halved by the distributed arrangement of scan concentrated periods and the number of the scan pulses in the address cycle is set to two according to one embodiment of the invention;

FIG. 14 shows a sub-field scanning method where the field is quartered and the number of the scan pulses in the address cycle is set to two according to another embodiment of the invention;

FIG. 15 shows the other sub-field scanning method obtained in the same condition as FIG. 14;

FIG. 16 shows the sub-field scanning method showing the result when the field of FIG. 14 overlaps twice;

FIG. 17 shows the sub-field scanning method showing the result when the field of FIG. 14 overlaps thrice;

FIG. 18 shows basic driving waveforms for discharging high resolution AC PDP of the invention;

FIG. 19 shows waveforms made by adding stability pulse to data electrode of the waveforms of FIG. 18;

FIG. 20 shows a sub-field scanning method using the distributed arrangement of scan concentrated periods, by way of the waveforms of FIGS. 18 and 19;

FIG. 21 shows a data inputting method when there are two addressing blocks in a basic block of FIG. 20;

FIG. 22 shows a data inputting method when there is one addressing block in the basic block of FIG. 20; and FIG. 23 shows a data inputting method when there is no addressing block in the basic block of FIG. 20.

DETAILED DESCRIPTION OF PREFERRED EMBODIMENT

Reference will now be made in detail to the preferred embodiments of the present invention, examples of which are illustrated in the accompanying drawings.

Figure 2:
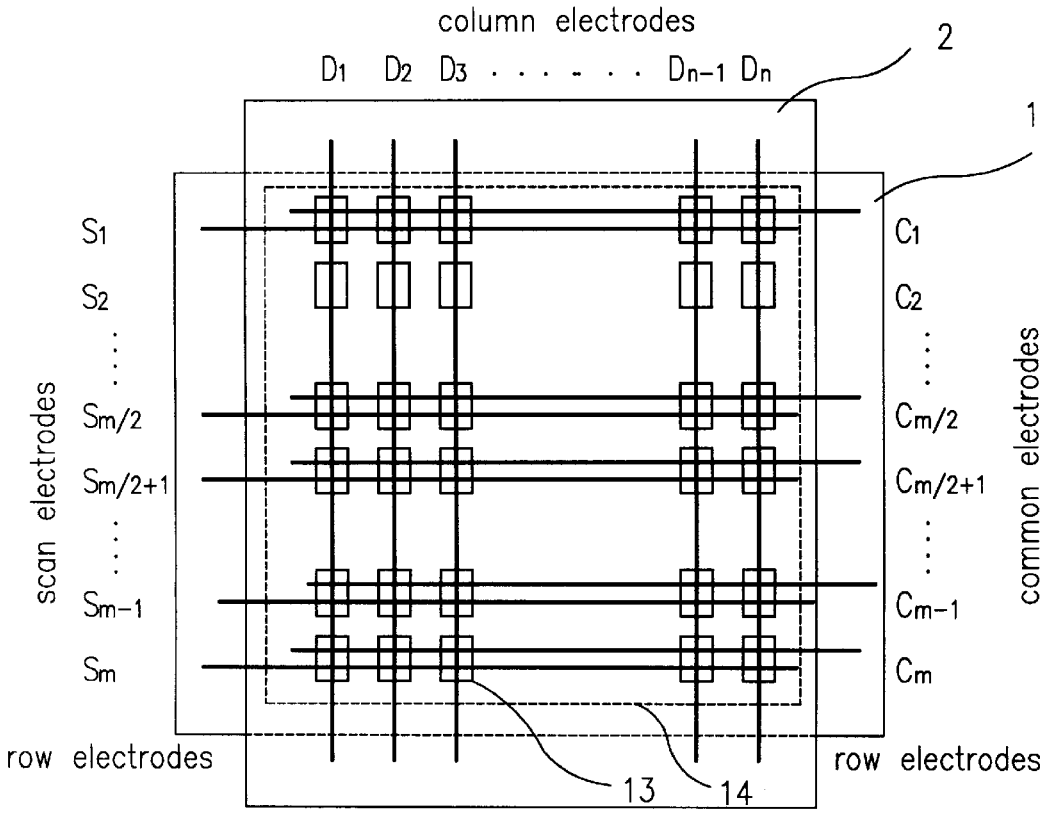
FIG.2 prior art
FIG. 2 shows the entire layout of a PDP having conventional AC PDP electrodes.
Figure 7:
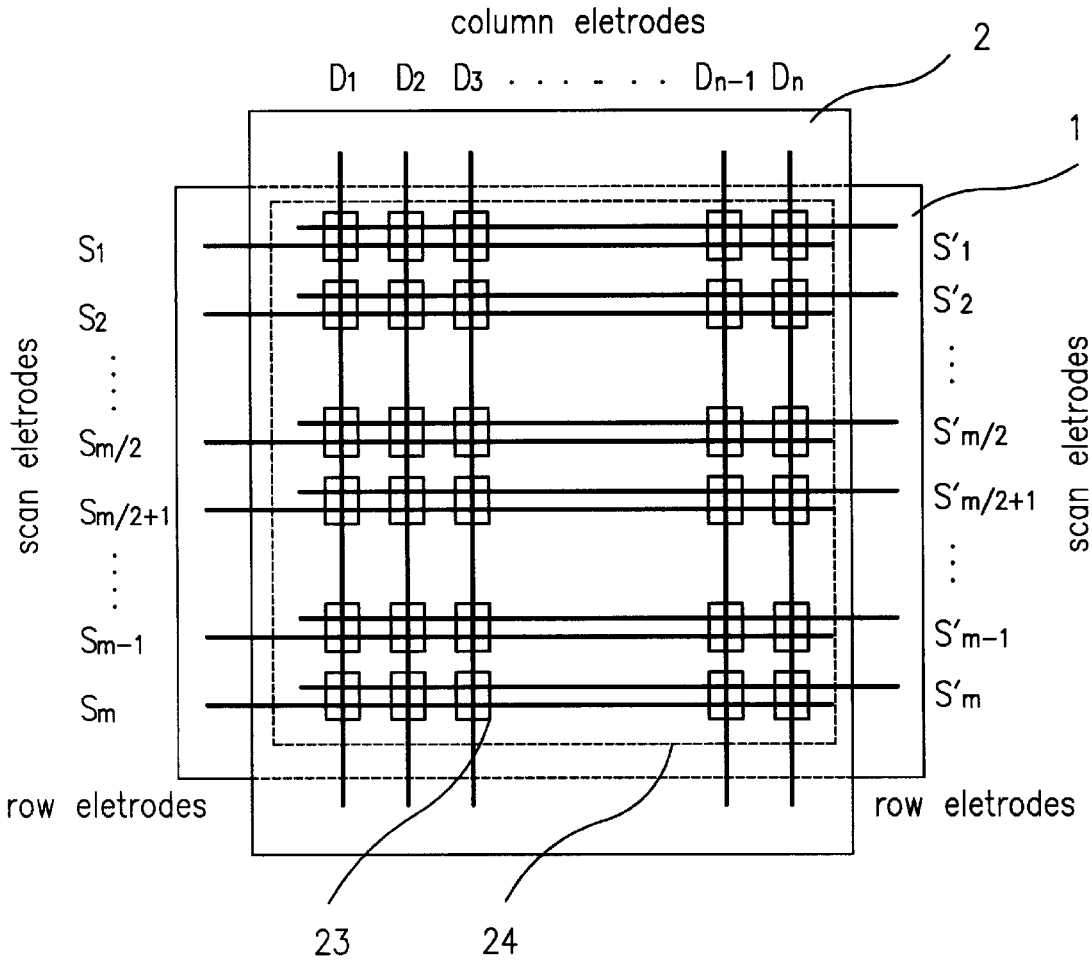
FIG. 7 shows an arrangement of AC PDP electrodes of the invention.

In comparison to the electrode arrangement of the conventional tri-electrode area-discharging AC PDP of FIG. 2, in FIG. 7 of the invention, the row electrodes to which only the sustain pulse is applied is replaced with the scan electrodes which can receive the scan pulse and the erase pulse as well as the sustain pulse.

Figure 8:
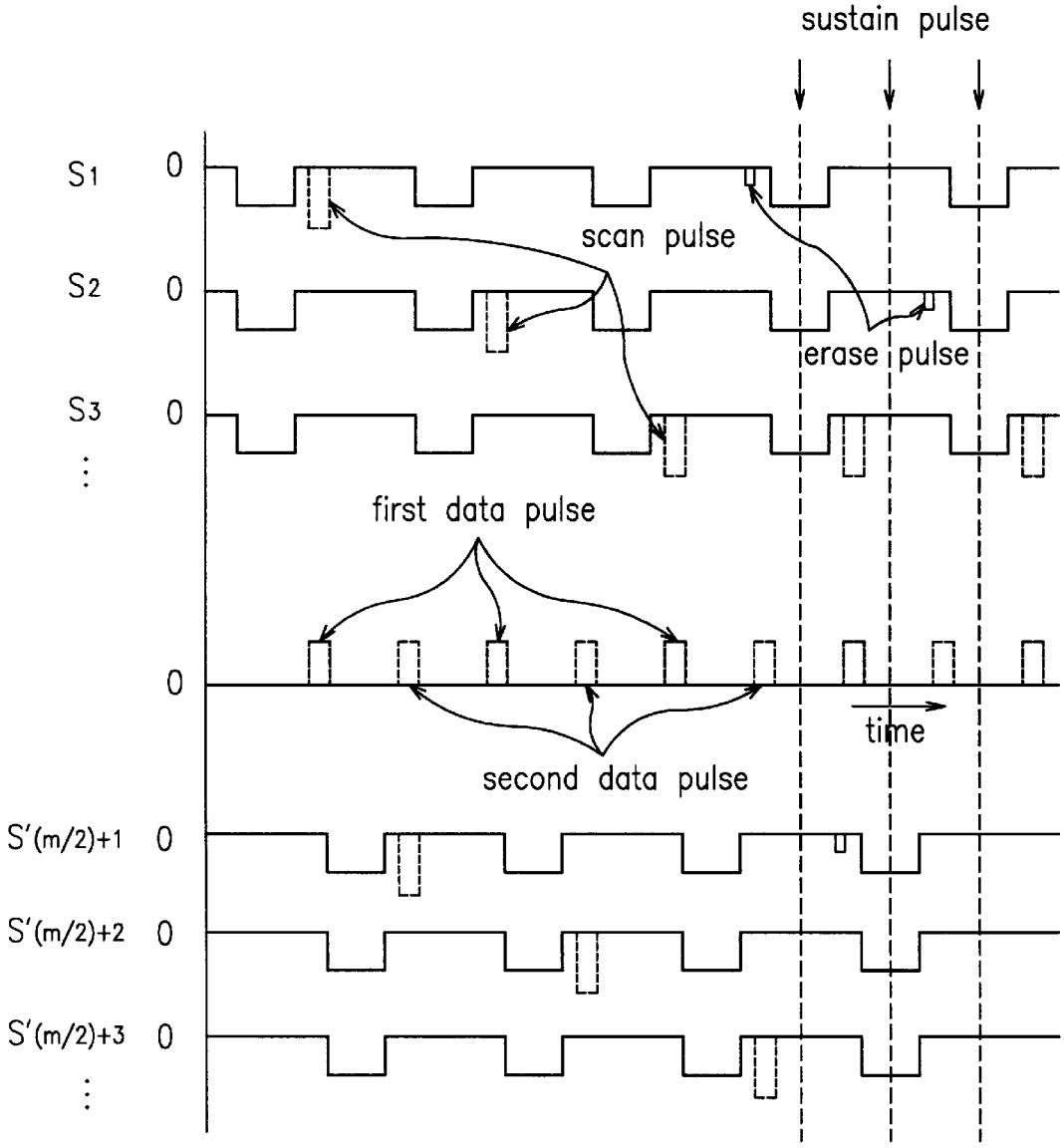
FIG. 8 shows the driving waveforms of FIG. 7.

With the operational waveforms of FIG. 8 under the electrode arrangement, the scan pulse applied to the first scan electrodes S lying on the left side of FIG. 7 and the second scan electrodes S' lying on the right side of FIG. 7 are positioned next to each of the sustain pulses not to overlap with each other, the two rows are processed in one cycle of the sustain pulse.

For example, as shown in FIG. 8, the field is divided into two areas, the upper areas $S_1$, $S_2$ through $S_{m/2}$ and the lower areas $S'_{(m/2)+1}$, $S'_{(m/2)+2}$ through $S'_m$. Data of the upper area are firstly addressed by $S_1$ scanning and data of the lower area are secondly addressed by $S'_{(m/2)+1}$ scanning. Thereafter, the scanning returns to the second scan line $S_2$ of the upper area, and then the second scan line $S'_{(m/2)+2}$ of the lower area, so that the data addressing is interlaced between the upper and lower areas to display a sub-field. Here, the data addressed to the upper and lower area are different from each other. If one bit digital image data are addressed to the upper area, other data excluding the one bit digital image data are addressed to the lower area.

After this data addressing is done as above, digital image data having a brightness corresponding to each of bits are composed, thereby displaying more higher gray scale. Therefore, in case of the large field, the gray scale of 256 units with high resolution can be completely realized through the invention.

Figure 4:
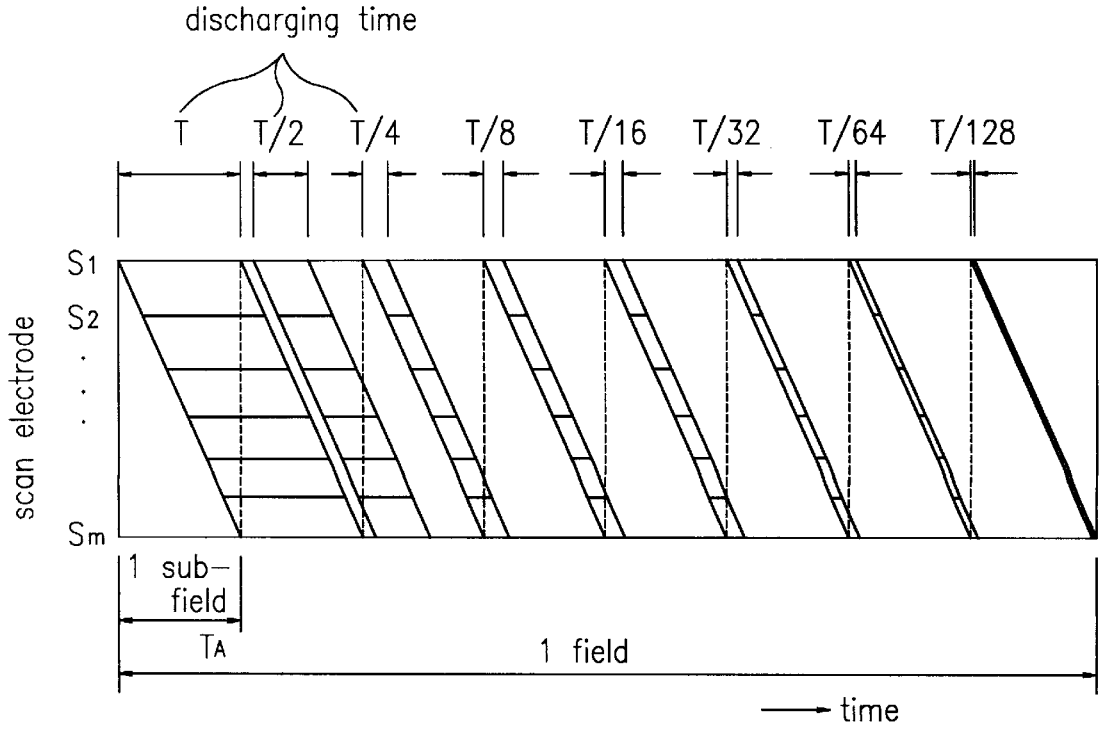
FIG.4 prior art
FIG. 4 is an exemplified diagram according to a sub-field scanning method using the driving waveforms.
Figure 5:
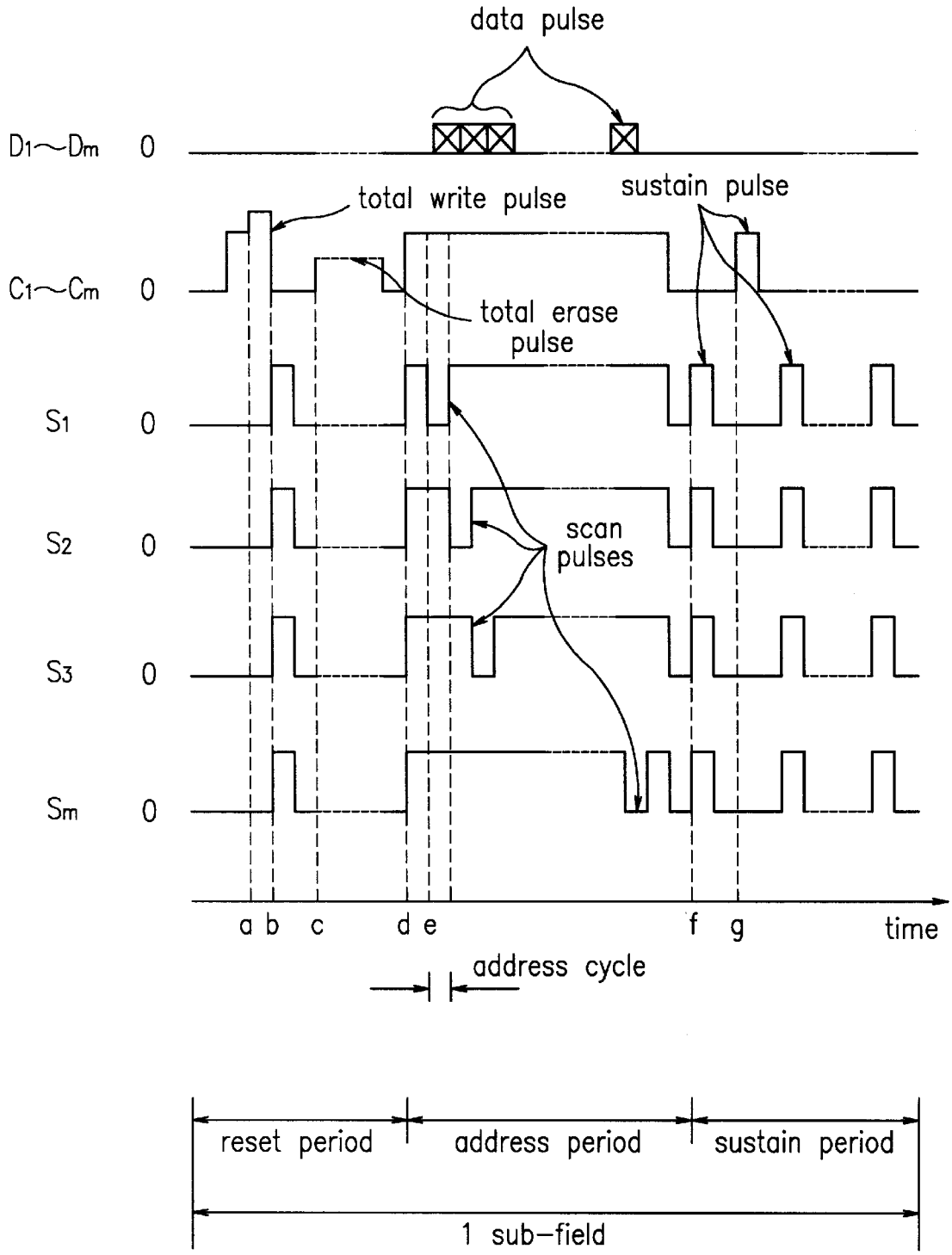
FIG.5 prior art
FIG. 5 shows the driving waveforms of FIG. 3.
Figure 6:
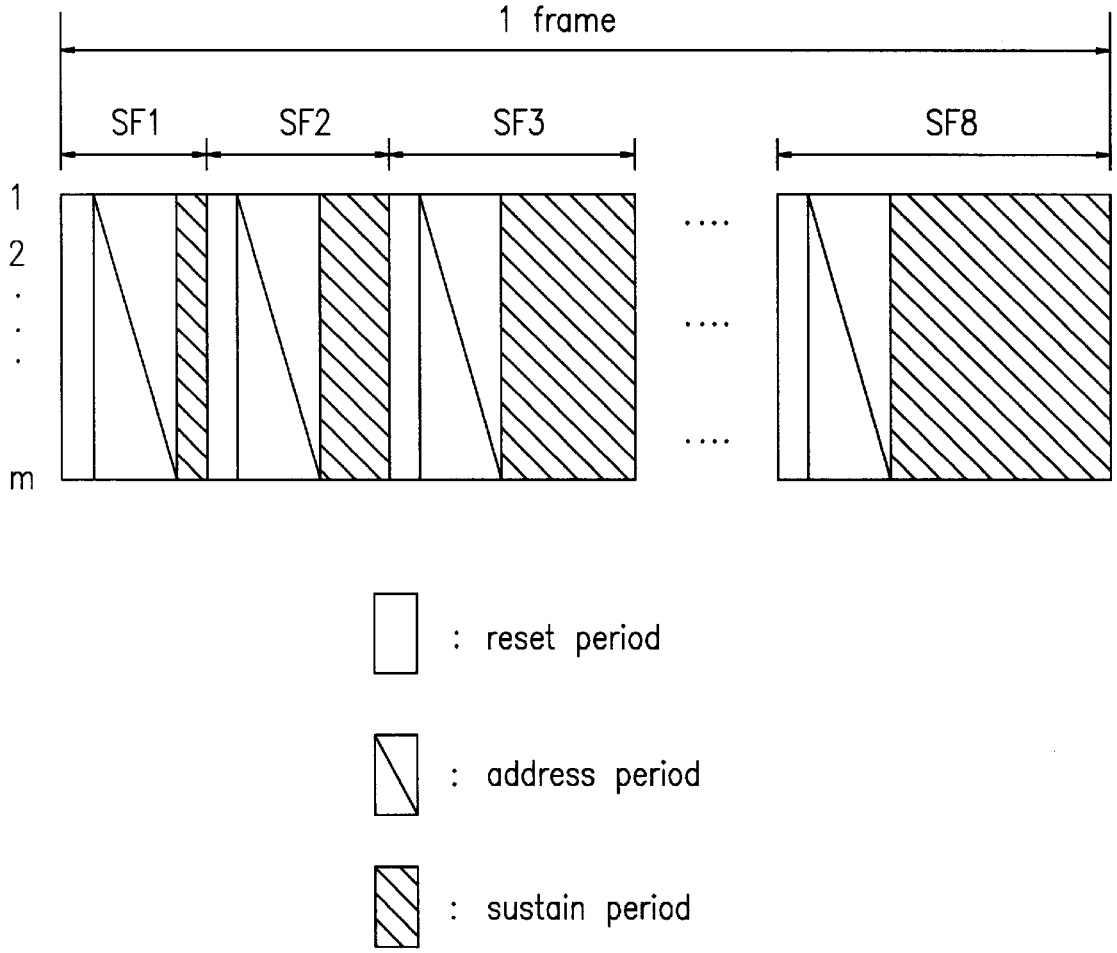
FIG.6 prior art
FIG. 6 is an exemplified view according to a sub-field scanning method by way of the driving waveforms of FIG. 5.

Furthermore, from the idea of displaying by dividing the field into two areas, in another embodiment of the invention, the field can be divided into N areas, and the different digital image data of eight bits are composed and addressed to the divided areas. For example, as shown in FIG. 9, a field of PDP is divided into N areas($N \neq 1$, natural number) in a direction of the row electrode, namely, scan line. The sub-field scan method of FIG. 4 is applied to each of the divided sub-fields. In case of randomly changing the bit order of the sub-field, the part marked with deviant lines denotes the state of maintaining the discharging, and the rest part denotes the state where the discharging stops. The scan flow chart with respect to the random sub-field is denoted as a parallelogram. The left sloping side is for the address block, the right sloping side is for the erase block, and the part between the address block and the erase block is named sustain section.

A roll of each block is to sequentially input the scan pulse by one row from the first row electrodes and determine the cells where the discharging should be maintained and another cells where the discharging should not be generated in the sustain section. In the sustain section, if the address block is determined, the state of the cell is continuously maintained. In the erase block, the erase pulse is input by one row sequentially from the highest row electrode so that the discharging in the corresponding cells is erased.

Figure 9A:
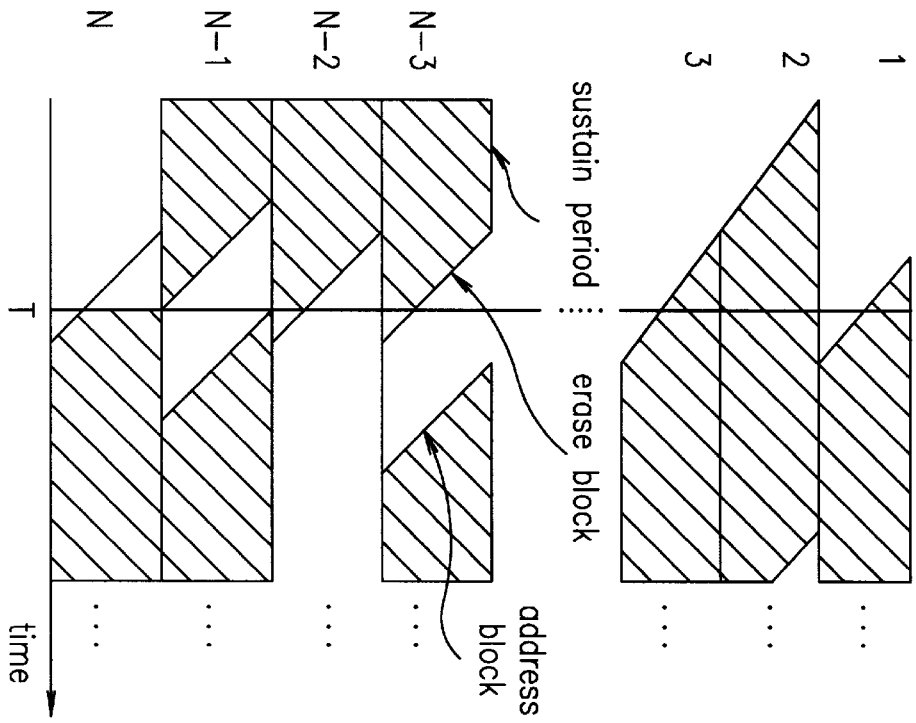
FIGS. 9A and 9B are exemplified views partially showing the sub-field scanning method can be applied when the AC PDP field is divided into N areas in a direction of a column electrode according to the invention.

FIG. 9A shows the general scan flow chart. On the basis of the time point T of the time axis, there is the address block in the first row electrode. The sustain section is only in the second row. The addressing block is in the third block. Continuously, the erasing block is in the (n−3)th block, erasing block is in the (n−2)th block, no block is in the (n−1)th block, and the address block is in the nth block. Here, the realized sub-field is in the state where the different digital image data are mixed in each of scan lines.

Figure 9B:
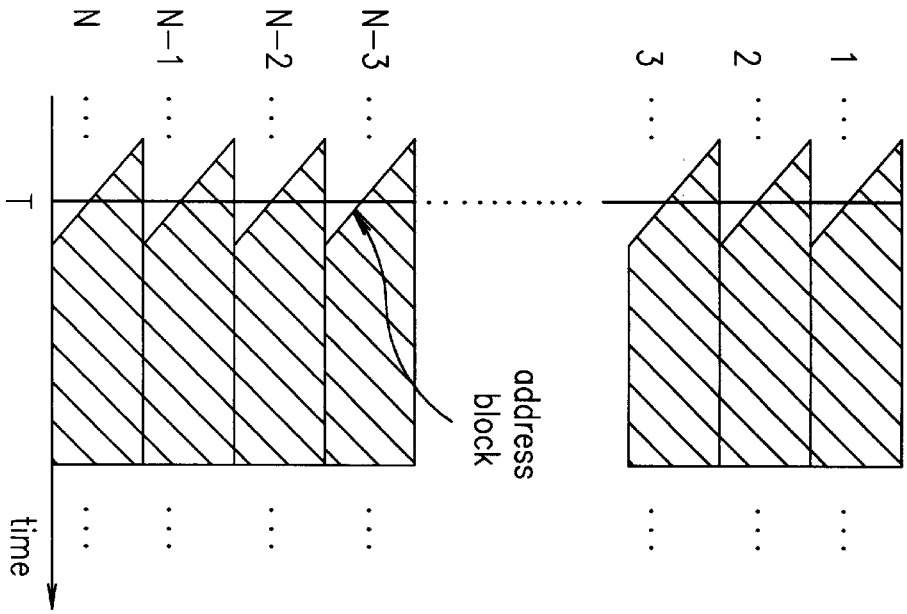

But, in the time point T of FIG. 9B, all row electrode blocks include the address block only. Accordingly, in the random time point T, all sustain, address(or scan) and erase pulses are required therefor.

Therefore, in FIG. 9A, the addressing section required for the actual driving is distributed because the address, erase and sustain blocks are in the time point T of the time axis. In FIG. 9B, as there is only addressing block in the same time point, the driving should be done concentrically, so that the former is more flexible than the latter, the former having an enhancement in brightness also.

Figure 3:
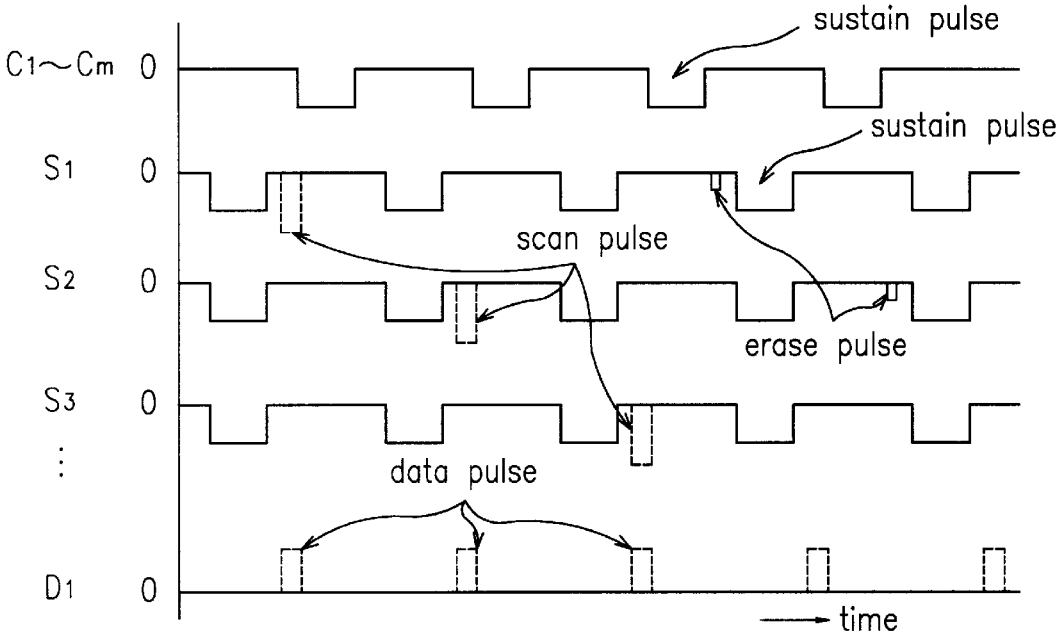
FIG.3 prior art
FIG. 3 shows waveforms of FIG. 2.
Figure 10:
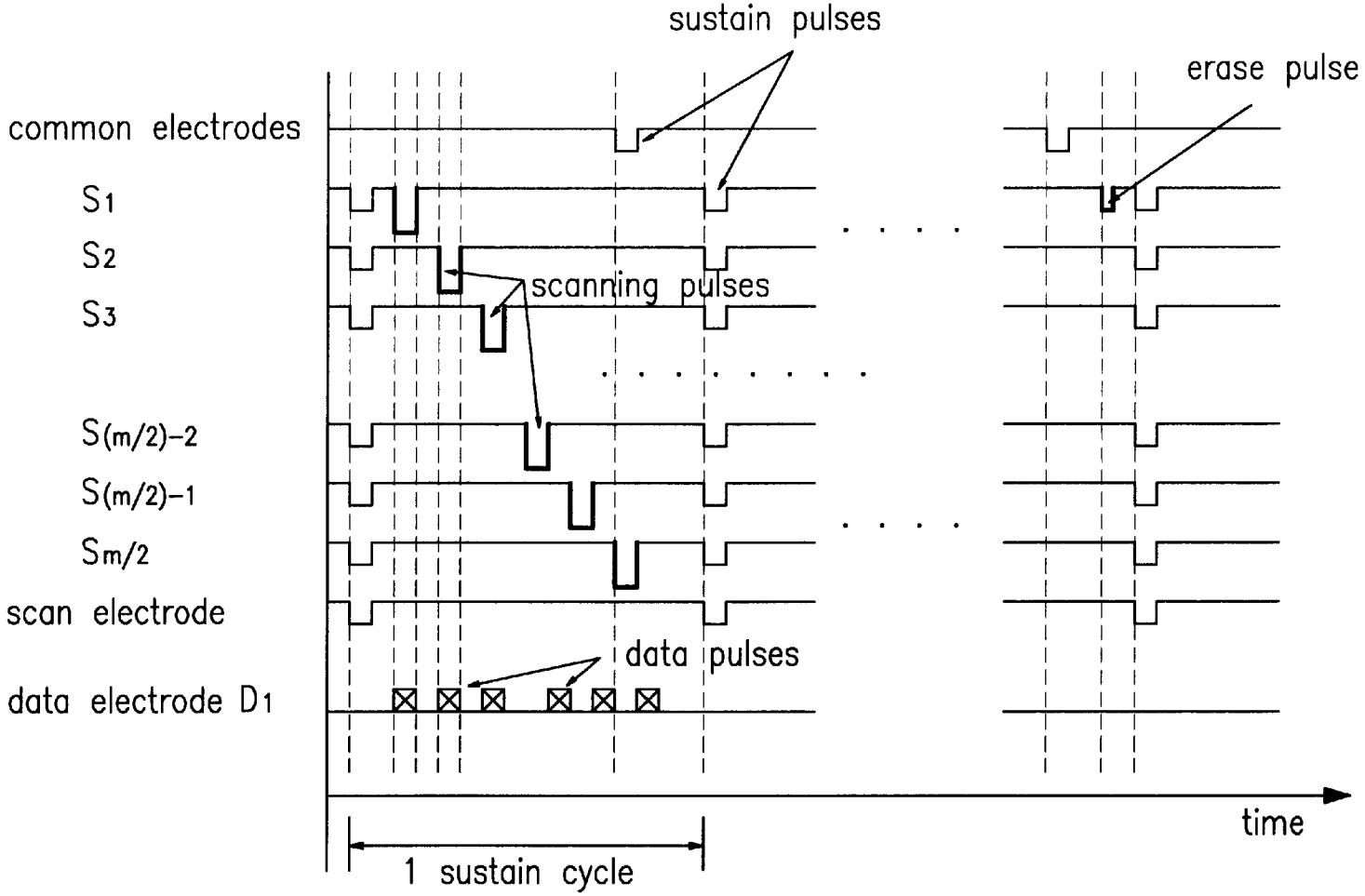
FIG. 10 shows the driving waveforms of the time when N scan pulses ($N \neq 1$) are input in one sustain cycle by correcting the waveforms of FIG. 3.
Figure 11:
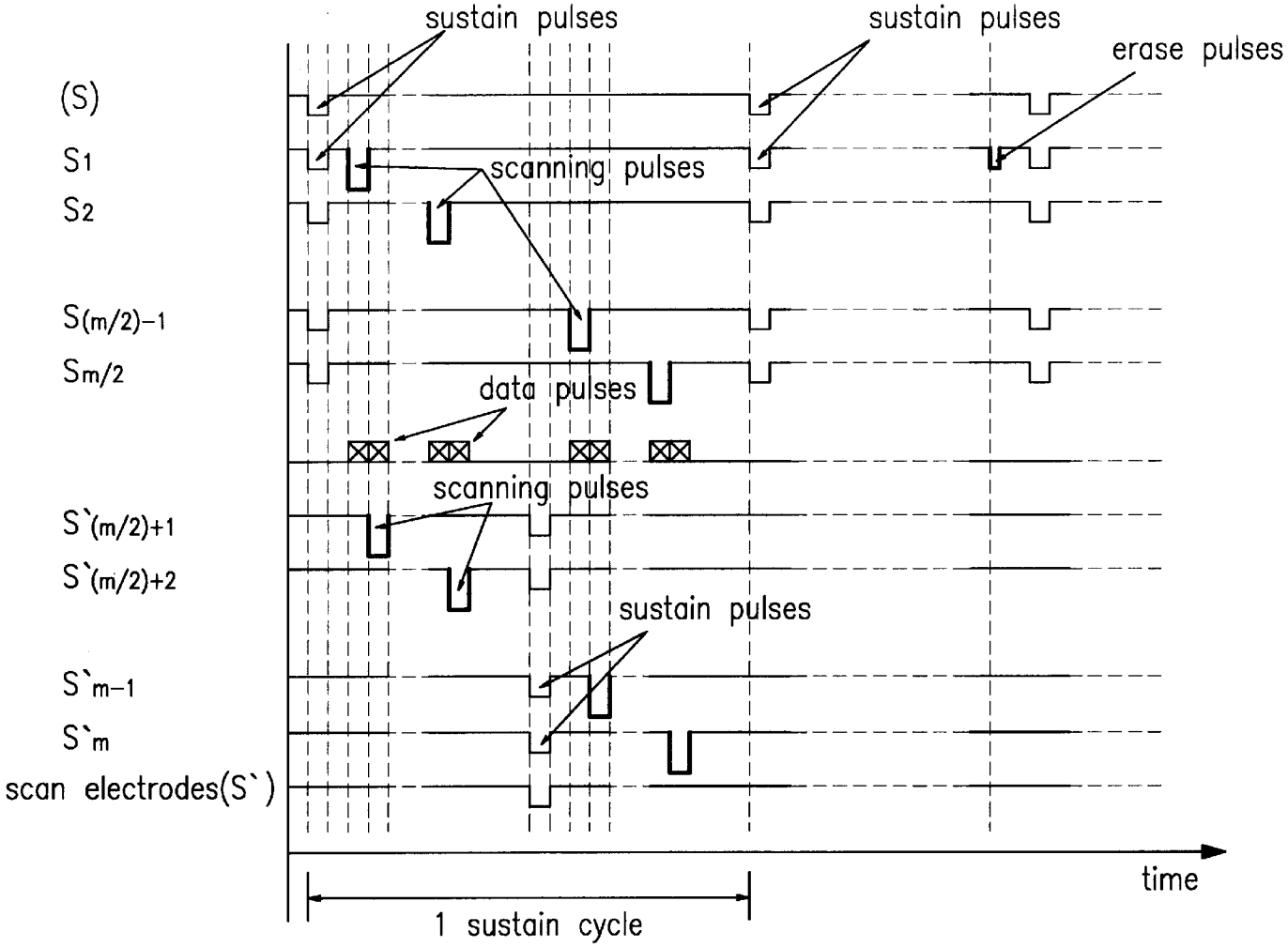
FIG. 11 shows the driving waveforms of the time when N scan pulses ($N \neq 1$) are input in one sustain cycle by correcting the waveforms of FIG. 8.

FIGS. 10 and 11 show the representative waveforms for realizing the sub-field scan method in the sub-field divided into a plurality of areas. The portion in the driving waveforms of FIGS. 3 and 8, to which the scan pulse is input is enlarged in FIGS. 10 and 11 to thereby driving more than one scan electrode in one sustain cycle.

The number of the scan pulse in one sustain cycle is set to the maximal number of the addressing block allowed to be the same point on the time axis in the timing chart of the sub-field scan method. For example, if the number of the addressing block in one sustain cycle is N, the number of the scan pulse in one sustain cycle is also set to N. Thereafter, the number of the scan pulse in one sustain cycle is set as the number of the scan pulse in the address cycle.

Referring to FIG. 11, a field is divided into two parts, upper and lower areas. To realize one sub-field, the scan electrodes $S_1, S_2, \ldots, S_{m/2}$ of the upper area and those $S'_{(m/2)+1}, S'_{(m/2)+2}, \ldots, S'_m$ of the lower area are alternately driven within a sustain period.

Thus different digital image data are concurrently addressed during the alternate scanning, which results in a high resolution.

One field is realized when eight sub-fields are all sequentially displayed.

Figure 12:
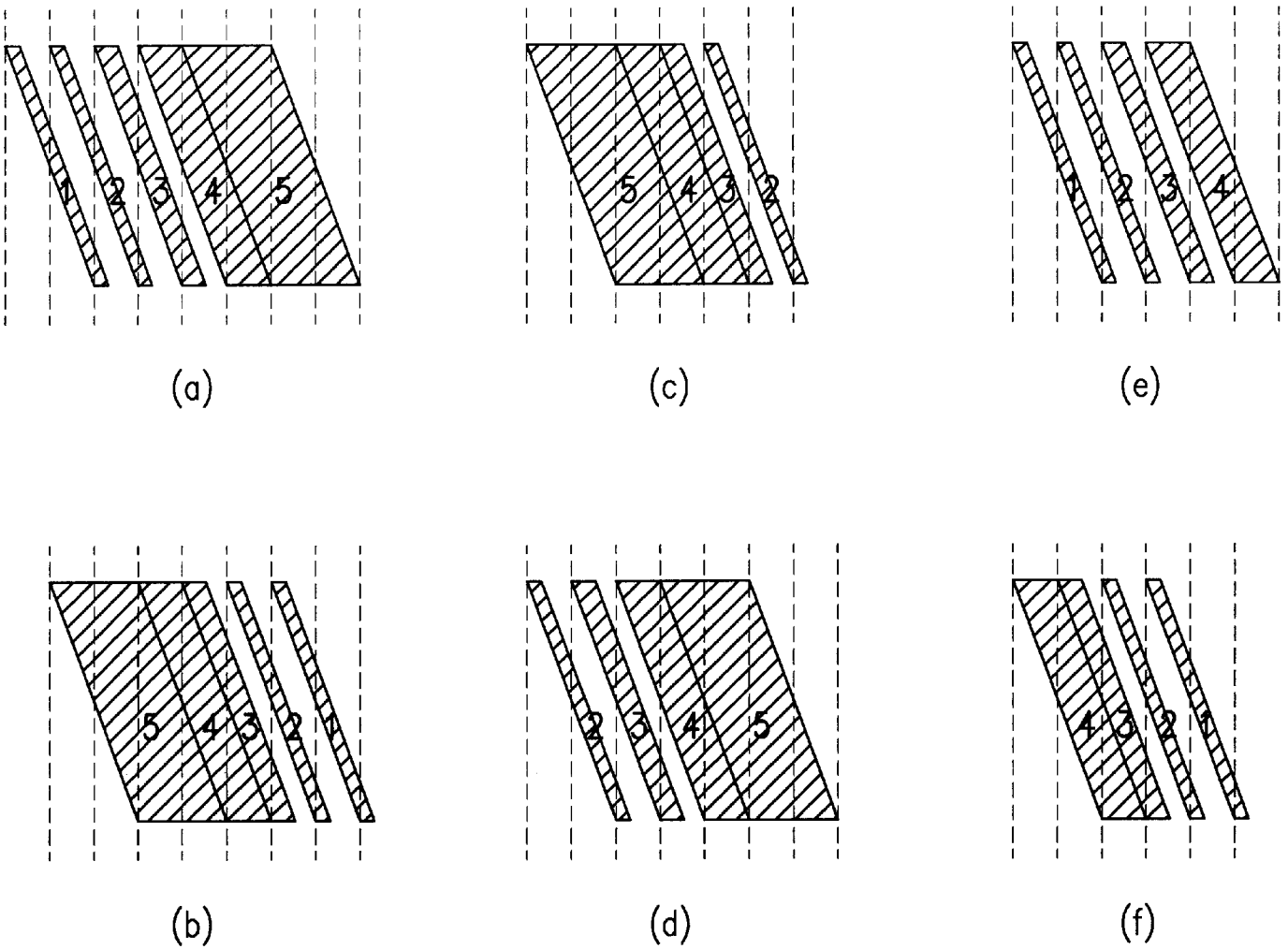
FIG. 12 is a timing view showing a scan concentrated period when sub-fields of lower bits form the PDP field of the invention.

As shown in FIG. 12, for example, a scan concentrated period is the time that the sub-fields of lower bits 1 (LSB), 2, 3, 4 and 5 are scanned in succession. The scan concentrated period is composed of a set of all five sub-fields having lower bits 1 (LSB), 2, 3, 4 and 5, or a set of four elements out of the sub-fields. The respective sub-fields are successively scanned with two or less scan pulses in an address cycle.

Referring to FIG. 12, five sub-fields are successively scanned in order of lower bits 1, 2, 3, 4 and 5 in the scan concentrated period of (a), and in order of lower bits 5, 4, 3, 2 and 1 in the scan concentrated period of (b). Four of the five sub-fields having lower bits 1, 2, 3, 4 and 5 are scanned in succession in each scan concentrated period of (c), (d), (e) and (f).

The time that a scanning is frequently achieved is termed scan concentrated period, in which the lower bits are concentrated.

A first preferred embodiment of a driving method for a high resolution AC PDP with high efficiency relates to the distributed arrangement of scan concentrated periods, by which after a field is divided into N (a natural number larger than 1) areas, as shown in FIG. 9, the scan concentrated periods in FIG. 12 are arranged without an overlap on the time axis in the respective divided areas.

A field is first divided into N (a natural number larger than 1) areas and the number of scan pulses in an address cycle is designated as M (a natural number, $2 \leqq M \leqq N+1$).

The minimum number of scan pulses in an address cycle is 2, which is the maximum number of scan pulses in the scan concentrated period at a point of time. The maximum number of scan pulses in an address cycle occurs when the scan concentrated period exists in a row electrode block at a point of time and each of the other row electrode blocks has one addressing block. It can be expressed by 2 (the number of scan pulses within an address cycle of the scan concentrated period)+{N−1} (the number of row electrode blocks exclusive of the row electrode block having the scan concentrated period), that is, N+1.

After the scan concentrated periods are arranged so as not to be overlapped at a time in each row electrode block, the rest of the sub-fields are arranged to satisfy the number of scan pulses in an address cycle.

FIG. 13 illustrates an application of the distributed arrangement of scan concentrated periods, where a field is divided into two areas (the number of divided areas N is 2) and the number of scan pulses in an address cycle M, that is, the number of addressing blocks is 2.

A half of an addressing block which corresponds to the block of a field is defined as "basic block", and the time required for addressing the basic block is designated as $T_{basic}$.

Each scan concentrated period as scanned in the pattern of (a) in FIG. 12 is positioned at the starting point of 1 frame in the upper area of the field and in the middle of 1 frame in the lower area. The rest of sub-fields which are not within the scan concentrated periods are arranged to have the number of scan pulses in an address cycle less than 2. The upper area of the field has sub-fields 6, 7 and 8 sequentially arranged on the right side hand of the scan concentrated period, while the lower area has sub-field 8 on the left side hand of the scan concentrated period and sub-fields 6 and 7 on the right side hand.

As shown in FIG. 13, after sub-field 8 in the lower area of the field is initially scanned and addressed in a basic block, the scan concentrated period starts from sub-field 1 to sub-field 5 in the upper area.

The lower end of sub-field 8 in the lower area is needed to be combined with the upper end of sub-field 1 in the upper area in order to form one sub-field.

Eight sub-fields may be displayed by addressing the image data in the upper and lower areas differently.

For the field divided into two areas as described above, the 1 frame time, the total sustain time, and the efficiency can be calculated as follows.

$$\text{1 frame time}=43T_{basic}\text{total sustain time}=(16+8+4+2+1+0.5+0.25+0.125)T_{basic}=31.875T_{basic}$$

$$\text{Efficiency}=31.875\times100/43=74.13\%$$

This calculation shows an enhancement in the efficiency compared with prior art.

FIG. 14 illustrates an application of the distributed arrangement of scan concentrated periods, where a field is divided into four areas (the number of divided areas N is 4) and the number of scan pulses in an address cycle M is 2.

As In the case that a field is divided into two areas, scanning and addressing are controlled so that each scan concentrated period having the sub-fields 1, 2, 3, 4 and 5, in order not to be overlapped, lies on the left side in the middle of 1 frame in block 1, at the end of 1 frame in block 2, at the starting point of 1 frame in block 3, and on the right side in the middle of 1 frame in block 4.

The rest of sub-fields which are not within the scan concentrated periods are arranged to have the number of scan pulses in an address cycle less than 2.

Block 1 has sub-fields 6 and 7 sequentially arranged on the left side hand of the scan concentrated period, and sub-field 8 on the right side hand.

Block 2 has sub-fields 8, 6 and 7 sequentially arranged on the left side hand of the scan concentrated period.

Block 3 has sub-field 6 on the left side hand of the scan concentrated period, and sub-fields 7 and 8 sequentially on the right side hand.

Block 4 has sequential sub-fields 8 and 6 on the left side hand of the scan concentrated period, and sub-field 7 on the right side hand.

For the field divided into four areas, as described above, the 1 frame time, the total sustain time, and the efficiency can be calculated as below.

$$\text{1 frame time}=38T_{basic}$$

$$\text{Total sustain time}=(16+8+4+2+1+0.5+0.25+0.125)T_{basic}=31.875T_{basic}$$

$$\text{Efficiency}=31.875\times100/38=83.88\%$$

This calculation shows that the efficiency is much enhanced relative to the field divided into two areas.

FIG. 15 illustrates another application of the distributed arrangement of scan concentrated periods, where a field is divided into four areas (the number of divided areas N is 4) and the number of scan pulses in an address cycle M is 2.

As in the case that a field is divided into four areas, the scan concentrated periods in row electrode blocks 1 and 2 have sub-fields 5, 4, 3, 2 and 1 sequentially arranged, with those in row electrode blocks 3 and 4 having sequential sub-fields 5, 4, 3, 2 and 1. Each of the scan concentrated periods, so as not to be overlapped, lies at the end of 1 frame in row electrode block 1, on the left side in the middle of 1 frame in row electrode block 2, on the right side in the middle of 1 frame in row electrode block 3, and at the starting point of 1 frame in row electrode block 4.

The rest of sub-fields which are not within the scan concentrated periods are arranged to have the number of scan pulses in an address cycle less than 2.

Block 1 has sub-fields 8, 7 and 6 sequentially arranged on the left side hand of the scan concentrated period.

Block 2 has sequential sub-fields 7 and 6 on the left side hand of the scan concentrated period, and sub-field 8 on the right side hand.

Block 3 has sub-field 8 on the left side hand of the scan concentrated period, and sub-fields 6, 7 and 1 sequentially arranged on the right side hand.

Finally, block 4 has sequential sub-fields 6, 8, 7 and 1 on the right side hand of the scan concentrated period.

For the field divided into four areas, as described above, the 1 frame time, the total sustain time, and the efficiency can be calculated as below.

$$\text{1 frame time}=\mathbf{41}T_{basic}$$

$$\text{Total sustain time}=(16+8+4+2+1+0.5+0.25+0.125)T_{basic}=31.875T_{basic}$$

$$\text{Efficiency}=31.875\times100/41=77.74\%$$

After all process for the distributed arrangement of scan concentrated periods is completed, a sub-field scanning timing diagram can be arranged successively P (a natural number larger than 1) times from upper to lower areas and a field is divided into N×P areas. Thus, the number of column electrodes per block is reduced by 1/P times and that of scan concentrated periods is increased to N×P, with increasing the number of scan pulses within an address cycle by P times.

FIG. 16 illustrates an embodiment of the field divided into 8 areas, where the diagram of FIG. 14 is arranged two times, that is, P=2.

As the field is divided into 8 (=2N) areas, the number of column electrodes per block is reduced by 2 times and that of scan concentrated periods is incremented to 8 (=2N), with increasing the number of scan pulses within an address cycle to 4 (=2×2).

FIG. 17 illustrates an embodiment of the field divided into 12 areas, where the diagram of FIG. 14 is arranged three times, that is, P=3.

As the field is divided into 12 (=3N) areas, the number of column electrodes per block is reduced by 3 times and that of scan concentrated periods is increased to 12 (=3N), with increasing the number of scan pulses in an address cycle to 6 (=3×2).

A driving method for a high resolution AC PDP, by which scanning and sustain pulses are fed into different column electrodes at the same time in order to secure the time required for a scanning to the maximum, is described below.

Figure 1:
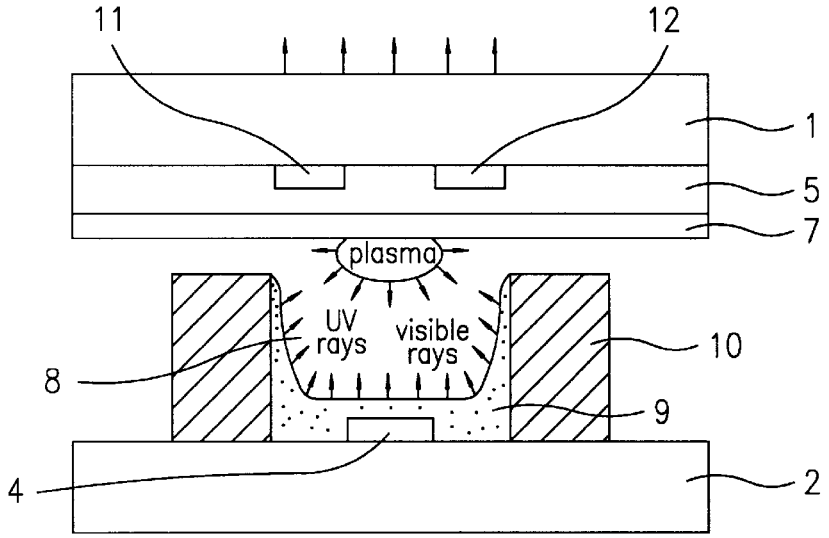
FIG. 1 is a sectional view of a general AC PDP cell having three electrodes.

It is supposed that in the three electrode surface discharged AC PDP structure as illustrated in FIG. 1, a positive (+) sustain pulse is previously applied to the common electrode and thus the positive (+) wall charges are formed in the scan electrode with the negative (−) wall charges formed in the common electrode.

When the data electrode has the positive (+) voltage which is half the sustain voltage and the sustain voltage is applied to the scan electrode, a discharge occurs between the scan and common electrodes and the voltage of the data electrode has no critical effect on the sustain discharge.

The sustain discharge is not affected critically even when the voltage of the data electrode is zero while the sustain discharge is maintained.

On the contrary, even when there is no sustain discharge caused by the sustain pulses applied to the scan and common electrodes, the data electrode with a voltage between zero and half the sustain voltage does not have a critical effect on the sustain discharge.

Based on the above fact, while the data pulses with a voltage half the sustain voltage are successively applied to the data electrode, the PDP is divided into rows needed to be scanned in a given time and otherwise rows so that the scan pulses are applied in succession to the rows to be scanned and the sustain pulses are to the rows not to be scanned, in synchronization with the data pulses.

This method extends the time available to input data to the total 1 frame time, and by this way around 1700 row electrodes can be driven supposed that the 1 frame time is 1/60 (sec), the data pulse 1.2 μs, and the gray level 256.

Hereinafter, the method of applying data and sustain pulses as described above will be referred to as addressing sustain concurrent driving method.

FIG. 18 illustrates an example of the addressing sustain concurrent driving method in accordance with the present invention.

Referring to FIG. 18, row electrodes are largely divided into two groups; selected row electrodes are row electrodes needed to be scanned within a basic block time and deselected row electrodes are ones that require a sustain instead of scanning.

The pulses applied to the respective electrodes are described below.

While the discharge of all cells belonging to the currently selected row electrodes is previously erased, a block write pulse causes a write discharge in all cells of the selected row electrodes.

Two sustain pulses stabilize the distribution of wall charges, and the scan pulses synchronized with the data pulses are fed into the scan electrodes, followed by a zero voltage applied to the row electrodes.

Each of the scan pulses is sequentially applied to all selected scan electrodes.

As shown in FIG. 18, the selected row electrodes are divided into blocks 1 and 2 so that scan pulses are applied alternately to the scan electrodes in blocks 1 and 2. This means, the number of scan pulses in an address cycle is designated as 2.

The scan and data pulses erase the discharge of cells having logic "1" data applied thereto, maintaining the wall charges of the cell with logic "0" data applied thereto.

While the selected row and data electrodes are addressed as described above, the deselected row electrodes receive sustain pulses to maintain the previous state.

Some cells belonging to the deselected row electrodes require erase pulses to realize a brightness, that is, block erase pulses which interrupt the inputs of data and scanning pulses.

As shown in FIG. 19, the driving waveforms of FIG. 11 are revised in order to achieve a stability.

Positive (+) stabilizing pulses applied to the data electrodes the time that a sustain discharge occurs in the deselected row electrodes prevent the fluorescent bodies from being destroyed due to a sputtering caused by ions.

When a stabilizing pulse is applied, the selected scan electrodes receive no scan pulses. Each pulse width in the waveform diagrams of FIGS. 18–19 can be regulated.

FIG. 20 illustrates a scanning achieved by means of the driving waveforms in FIGS. 18–19.

Referring to FIG. 20, the number of row electrodes in a PDP is m. A field is divided into 8 parts in the direction of column electrodes; four upper blocks are designated as scanning block 1 (1 to m/2) with four lower blocks designated as scanning block 2 (m/2+1 to m).

The total 1 frame time is divided into 45 equivalent parts each of which is termed basic block, and the portion indicating m/8 row electrodes to be scanned in the basic block, that is, the hatched part of FIG. 13 is referred to as addressing block.

Since the number of scan pulses in an address cycle is determined as 2 in the driving waveforms of FIGS. 18–19, the number of scan pulses in an address cycle according to the scanning method in FIG. 20 is also designated as 2.

When there are at most two addressing blocks in a basic block, each of the addressing blocks lies in scanning blocks 1 and 2. With only one addressing block, it may be in either of the scanning blocks 1 and 2. As for basic block 2, there are totally two addressing blocks each of which lies in the second blocks of the scanning blocks 1 and 2.

In the scanning method, one row electrode is selected alternately from the addressing block 1 in the scanning block 1 and the addressing block 2 in the scanning block 2, as shown in FIG. 21.

In scanning basic block 11 in which one addressing block lies in the first block of the scanning block 2, the scanning block 1 has no addressing block so that a scanning pulse may be applied during a time for addressing block 2 instead of addressing block 1, as shown in FIG. 22.

Finally, in scanning basic block 42 where no addressing block is either of scanning blocks 1 and 2, as shown in FIG. 23, there is no scan pulse applied.

The sub-field arrangement in each row electrode block uses the distributed arrangement of scan concentrated periods. In FIG. 20, as the number of scan pulses in an address cycle of the scan concentrated period is not 2 but 1, the scan concentrated periods consisting of lower bits can be overlapped among them as long as the number of scan pulses in an address cycle of the total timing diagram is 2.

The scan concentrated period in row electrode block 1 comprising the first and second blocks of scanning block 1 is located in the middle of 1 frame, that in row electrode block 2 comprising the third and fourth blocks of scanning block 1 is at the end of 1 frame, and that in row electrode block 3 comprising the first and second blocks of scanning block 2 is at the starting point of 1 frame.

The scan concentrated period in row electrode block 4 comprising the third and fourth blocks of scanning block 2 lies in the middle of 1 frame, so that the starting point of the scan concentrated period in row electrode block 2 is overlapped with the end of the scan concentrated period in row electrode block 4.

The end part of the scan concentrated period in row electrode block 3 is overlapped with the starting part of the scan concentrated period in row electrode block 1, the fore part of the scan concentrated period in row electrode block 4 being overlapped with the rear part of the scan concentrated period in row electrode block 1. The rest of sub-fields which are not in the scan concentrated periods are arranged to have the number of scan pulses in an address cycle less than 2.

Row electrode block 1 has sub-fields 6 and 7 sequentially arranged on the left side hand of the scan concentrated period, and sub-field 8 on the right side hand.

Row electrode block 2 has sequential sub-fields 7 and 8 on the left side hand of the scan concentrated period, and sub-field 6 on the right side hand.

Row electrode block 3 has sub-field 6 on the left side hand of the scan concentrated period, and sub-fields 8 and 7 sequentially arranged on the right side hand.

Finally, row electrode block 4 has sub-field 8 on the left side hand of the scan concentrated period, and sub-fields 7 and 6 sequentially on the right side hand.

This method secures the time required for scanning one frame so that utmost 1700 row electrodes can be driven.

As described above, the present invention provides an effective method of driving a high resolution AC PDP by using a distributed arrangement of scan concentrated periods and an addressing sustain concurrent driving method to secure the scanning time to the maximum by applying scanning and sustain pulses to different row electrodes at the same time.

Compared with prior art sub-field driving method, the present driving method for a high resolution AC PDP makes it possible to drive 1700 row electrodes in the maximum by securing the time required for scanning one frame.

It will be apparent to those skilled in the art that various modifications and variations can be made in the method of driving PDP of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel, comprising:

dividing row electrodes into a first area to be scanned and a second area to be sustained in a given time period;

simultaneously applying scan pulses and sustain pulses, wherein the scan pulses are applied successively to row electrodes of the first area row by row, and wherein the sustain pulses are applied to row electrodes of the second area; and applying address pulses to data electrode in synchronization with a scan pulse.

2. The method as claimed in claim 1, wherein the scan pulse is applied to the row electrodes to be scanned regardless of when the sustain pulse is applied.

3. The method as claimed in claim 1, wherein the scan pulse and the data pulse are not applied to the row electrodes and data electrodes respectively when the sustain pulse has a rising edge.

4. The method as claimed in claim 1, further comprising the step of:

applying a stabilizing pulse to the data electrodes when the sustain pulse has a rising edge.

5. The method as defined in claim 1, wherein a address pulses are data to construct the sub-field of 640 scan lines bit by bit corresponding to a predetermined luminance, out of digital image data of eight bits.

6. The method as defined in claim 5, wherein subfields formed with a combination of digital image data of bits different from those of a previous subfield are sequentially scanned seven times.

7. The method as defined in claim 1, wherein the first area is divided into at least two sub-blocks, and the scan pulses are alternately applied to the at least two sub-blocks.

* * * * *